US009475273B2

(12) United States Patent
Scharkus et al.

(10) Patent No.: US 9,475,273 B2
(45) Date of Patent: Oct. 25, 2016

(54) INK WIPING SYSTEM OF AN INTAGLIO PRINTING PRESS AND INTAGLIO PRINTING PRESS COMPRISING THE SAME

(71) Applicant: KBA-NOTASYS SA, Lausanne (CH)

(72) Inventors: Volker Scharkus, Würzburg (DE); Ralf Harald Sokol, Würzburg (DE); Volkmar Rolf Schwitzky, Würzburg (DE); Laurent Claude, St-Sulpice (CH); Alain Würsch, La Tour-de-Peilz (CH); Johannes Georg Schaede, Würzburg (DE)

(73) Assignee: KBA—NotaSys SA, Lausanne (CH)

( * ) Notice: Subject to any disclaimer, the term of this patent is extended or adjusted under 35 U.S.C. 154(b) by 0 days.

(21) Appl. No.: 14/383,768

(22) PCT Filed: Mar. 11, 2013

(86) PCT No.: PCT/IB2013/051920

§ 371 (c)(1),
(2) Date: Sep. 8, 2014

(87) PCT Pub. No.: WO2013/132471

PCT Pub. Date: Sep. 12, 2013

(65) Prior Publication Data

US 2015/0151532 A1 Jun. 4, 2015

(30) Foreign Application Priority Data

Mar. 9, 2012 (EP) ..... 12158948

(51) Int. Cl.

| | |
|---|---|
| ***B41F 9/08*** | (2006.01) |
| ***B41F 9/16*** | (2006.01) |
| ***B41F 31/07*** | (2006.01) |
| ***B41F 31/30*** | (2006.01) |
| ***B41F 9/10*** | (2006.01) |

(52) U.S. Cl.

CPC ..... *B41F 9/16* (2013.01); *B41F 9/1018* (2013.01); *B41F 31/07* (2013.01); *B41F 31/308* (2013.01)

(58) Field of Classification Search

CPC ..... B41F 9/18
USPC ..... 101/155
See application file for complete search history.

(56) References Cited

U.S. PATENT DOCUMENTS

| | | | | |
|---|---|---|---|---|
| 2,987,993 | A | 6/1961 | Giori | |
| 3,610,144 | A * | 10/1971 | Woessner | B41F 9/18 101/153 |
| 3,762,319 | A | 10/1973 | Gazzola et al. | |
| 3,785,286 | A | 1/1974 | Giori | |
| 3,789,757 | A * | 2/1974 | Motter | B41F 9/18 101/153 |
| 3,876,087 | A * | 4/1975 | Osta | B41F 9/18 101/216 |
| 3,900,595 | A | 8/1975 | Giori | |
| 4,046,070 | A * | 9/1977 | Halley | B41F 9/18 101/153 |
| 4,054,685 | A | 10/1977 | Giori | |
| 4,499,825 | A * | 2/1985 | Uno | B41F 9/10 101/155 |
| 4,516,496 | A | 5/1985 | Giori | |
| 4,781,116 | A * | 11/1988 | Harada | B41F 35/007 101/423 |
| 4,807,526 | A * | 2/1989 | Troyer | B65H 19/126 101/153 |
| 4,899,654 | A * | 2/1990 | Hoshi | B41F 9/10 101/157 |
| 4,901,641 | A * | 2/1990 | Steiner | B41F 9/18 101/152 |
| 5,062,359 | A | 11/1991 | Giori | |
| 5,062,360 | A | 11/1991 | Germann et al. | |
| 5,152,220 | A | 10/1992 | Lindner et al. | |
| 5,255,601 | A | 10/1993 | Blass et al. | |
| 5,282,417 | A | 2/1994 | Germann | |
| 5,899,145 | A | 5/1999 | Schaede | |
| 6,111,261 | A | 8/2000 | Bolza-Schunemann et al. | |
| 6,176,482 | B1 | 1/2001 | Reinhard et al. | |
| 6,341,556 | B1 * | 1/2002 | Endo | B41F 9/1018 101/155 |
| 6,779,445 | B2 | 8/2004 | Schaede | |
| 7,011,020 | B2 | 3/2006 | Dunninger et al. | |
| 7,913,641 | B2 | 3/2011 | Dupertuis et al. | |
| 8,231,125 | B2 | 7/2012 | Hendle et al. | |

| | | | |
|---|---|---|---|
| 8,302,558 | B2 | 11/2012 | Ripamonti et al. |
| 8,516,960 | B2 | 8/2013 | Bollettin et al. |
| 8,667,927 | B2 | 3/2014 | Dupertuis et al. |
| 2003/0010233 | A1 | 1/2003 | Schaede |
| 2004/0237816 | A1 | 12/2004 | Dunninger et al. |
| 2005/0127595 | A1 | 6/2005 | Hendle et al. |
| 2006/0144265 | A1 | 7/2006 | Dunninger et al. |
| 2007/0181016 | A1 | 8/2007 | Schaede |
| 2008/0216683 | A1 | 9/2008 | Dupertuis et al. |
| 2008/0245246 | A1 | 10/2008 | Dupertuis et al. |
| 2008/0268168 | A1 | 10/2008 | Ripamonti et al. |
| 2009/0096156 | A1 | 4/2009 | Hendle et al. |
| 2009/0183644 | A1 | 7/2009 | Bollettin et al. |
| 2012/0312179 | A1 | 12/2012 | Scheade et al. |
| 2012/0312180 | A1 | 12/2012 | Scheade et al. |
| 2013/0112095 | A1 | 5/2013 | Schaede et al. |

FOREIGN PATENT DOCUMENTS

| | | | |
|---|---|---|---|
| CH | 477 293 | | 10/1969 |
| EP | 0 091 709 | A1 | 10/1983 |
| EP | 0 406 157 | A1 | 1/1991 |
| EP | 0 415 881 | A2 | 3/1991 |
| EP | 0 475 890 | A1 | 3/1992 |
| EP | 0 526 398 | A1 | 2/1993 |
| EP | 0 563 007 | A1 | 9/1993 |
| EP | 0 873 866 | A1 | 10/1998 |
| EP | 1 602 483 | A1 | 12/2005 |
| EP | 2 399 745 | A1 | 12/2011 |
| EP | 2 524 805 | A1 | 11/2012 |
| EP | 2 524 809 | A1 | 11/2012 |
| WO | 118869 | | 8/1969 |
| WO | 97/36813 | A1 | 10/1997 |
| WO | 97/37329 | A1 | 10/1997 |
| WO | 01/54904 | | 8/2001 |
| WO | 03/047862 | | 6/2003 |
| WO | 03/070465 | | 8/2003 |
| WO | 2004/026580 | | 4/2004 |
| WO | 2005/118294 | | 12/2005 |
| WO | 2007/031925 | | 3/2007 |
| WO | 2007/031927 | | 3/2007 |
| WO | 2007/034362 | | 3/2007 |
| WO | 2007/116353 | | 10/2007 |
| WO | 2011/077348 | | 6/2011 |
| WO | 2011/077350 | | 6/2011 |
| WO | 2011/077351 | | 6/2011 |
| WO | 2011/161656 | | 12/2011 |
| WO | 2012/160476 | A1 | 11/2012 |
| WO | 2012/160478 | A1 | 11/2012 |

OTHER PUBLICATIONS

International Search Report for PCT/IB2013/051920, mailed Jun. 20, 2013.
Written Opinion for PCT/IB2013/051920, mailed Jun. 20, 2013.
U.S. Appl. No. 13/806,896, in the name of J. G. Schaede et al., filed Jul. 26, 2013.
U.S. Appl. No. 14/119,014, in the name of C. Laurent, filed Feb. 19, 2014.
U.S. Appl. No. 14/119,135, in the name of C. Laurent, filed Feb. 19, 2014.

* cited by examiner

*Primary Examiner* — Anthony Nguyen
(74) *Attorney, Agent, or Firm* — Nixon & Vanderhye P.C.

(57) ABSTRACT

There is described an ink wiping system (100; 100'; 100") of an intaglio printing press comprising a wiping tank (101) and a rotatable wiping roller assembly (102; 102*) supported on and partly located in the wiping tank (101) for wiping excess ink from the surface of a rotatable intaglio printing cylinder (80) of the intaglio printing press. The ink wiping system (100; 100'; 100") comprises a wiping roller retracting device (150) which forms an integral part of the ink wiping system (100; 100'; 100") and is adapted to be coupled to the wiping roller assembly (102; 102*) to move the wiping roller assembly (102; 102*) between a working position (W) where the wiping roller assembly (102; 102*) is supported on and partly located in the wiping tank (101) for cooperation with the intaglio printing cylinder (80) and a parking position (P) where the wiping roller assembly (102; 102*) is retracted out of the wiping tank (101) and away from the intaglio printing cylinder (80). In the working position (W) of the wiping roller assembly (102; 102*), the wiping roller retracting device (150) is coupled to the wiping roller assembly (102; 102*). The ink wiping system (100; 100'; 100") further includes, at the parking position (P), a storage section (110) adapted to receive the wiping roller assembly (102; 102*) which is retracted by the wiping roller retracting device (150).

22 Claims, 25 Drawing Sheets

INK WIPING SYSTEM OF AN INTAGLIO PRINTING PRESS AND INTAGLIO PRINTING PRESS COMPRISING THE SAME

This application is the U.S. national phase of International Application No. PCT/IB2013/051920, filed 11 Mar. 2013, which designated the U.S. and claims priority to EP Application No. 12158948.5, filed 9 Mar. 2012, the entire contents of each of which are hereby incorporated by reference.

TECHNICAL FIELD

The present invention generally relates to the wiping of rotatable intaglio printing cylinders of intaglio printing presses. More precisely, the present invention relates to an ink wiping system of an intaglio printing press and to an intaglio printing press comprising the same.

BACKGROUND OF THE INVENTION

Intaglio printing presses are widely used in security printing for printing security documents, especially banknotes. Prior art intaglio printing presses are for instance disclosed in Swiss Patent No. CH 477 293 A5, European Patent Applications Nos. EP 0 091 709 A1, EP 0 406 157 A1, EP 0 415 881 A2, EP 0 563 007 A1, EP 0 873 866 A1, EP 1 602 483 A1, and International Applications Nos. WO 01/54904 A1, WO 03/047862 A1, WO 2004/026580 A1, WO 2005/118294 A1, WO 2011/077348 A1, WO 2011/077350 A1, WO 2011/077351 A1, all assigned to the instant Applicant.

FIGS. 1 and 2 schematically illustrate a known intaglio printing press with an intaglio printing unit configuration similar to that disclosed in European Patent Application No. EP 0 091 709 A1.

FIG. 1 shows a sheet-fed intaglio printing press 1 comprising, as is usual in the art, a sheet feeder 2 for feeding sheets to be printed, an intaglio printing unit 3 for printing the sheets, and a sheet delivery unit 4 for collecting the freshly-printed sheets. The intaglio printing unit 3 typically includes an impression cylinder 7, a plate cylinder 8 carrying intaglio printing plates (in this example, the plate cylinder 8 is a three-segment cylinder carrying three intaglio printing plates 8*a*, 8*b*, 8*c* FIG. 2), an inking system 9 for inking the surface of the intaglio printing plates 8*a*, 8*b*, 8*c* carried by the plate cylinder 8 and an ink wiping system 10 for wiping the inked surface of the intaglio printing plates 8*a*, 8*b*, 8*c* carried by the plate cylinder 8 prior to printing of the sheets.

The sheets are fed from the sheet feeder 2 onto a feeder table and then onto the impression cylinder 7. The sheets are then carried by the impression cylinder 7 to the printing nip between the impression cylinder 7 and the plate cylinder 8 where intaglio printing is performed. Once printed, the sheets are transferred from the impression cylinder 7 to a sheet transporting system 11 in order to be delivered to the delivery unit 4. The sheet transporting system 11 conventionally comprises an sheet conveyor system with a pair of endless chains driving a plurality of spaced-apart gripper bars for holding a leading edge of the sheets (the freshly-printed side of the sheets being oriented downwards on their way to the delivery unit 4), sheets being transferred in succession from the impression cylinder 7 to a corresponding one of the gripper bars.

During their transport to the sheet delivery unit 4, the freshly printed sheets are preferably inspected by an optical inspection system 5. In the illustrated example, the optical inspection system 5 is advantageously disposed along the path of the sheet transporting system 11, right after the printing unit 3. Such an optical inspection system 5 is already known in the art and does not need to be described in detail. Examples of optical inspection systems adapted for use as optical inspection system 5 in the intaglio printing press of FIG. 1 are for instance described in International Applications Nos. WO 97/36813 A1, WO 97/37329 A1, WO 03/070465 A1 and WO 2011/161656 A1. Such inspection systems are in particular marketed by the Applicant under the product designation NotaSave®.

Before delivery, the printed sheets are preferably transported in front of a drying or curing unit 6 disposed after the inspection system 5 along the transport path of the sheet transporting system 11. Drying or curing could possibly be performed prior to the optical inspection of the sheets.

FIG. 2 is a schematic view of the intaglio printing unit 3 of the intaglio printing press 1 of FIG. 1. As already mentioned, the intaglio printing unit 3 basically includes the impression cylinder 7, the plate cylinder 8 with its intaglio printing plates 8*a*, 8*b*, 8*c*, the inking system 9 and the ink wiping system 10.

The inking system 9 comprises in this example four inking devices, three of which cooperate with a common ink-collecting cylinder or Orlof cylinder 9.5 (here a two-segment cylinder) that contacts the plate cylinder 8. The fourth inking device is disposed so as to directly contact the surface of the plate cylinder 8. It will be understood that the illustrated inking system 9 is accordingly adapted for both indirect and direct inking of the plate cylinder 8. The inking devices cooperating with the ink-collecting cylinder 9.5 each include an ink duct 9.10, 9.20, 9.30 cooperating in this example with a pair of inking rollers 9.11, 9.21 and 9.31, respectively. Each pair of inking rollers 9.11, 9.21, 9.31 in turn inks a corresponding chablon cylinder (also designated as selective inking cylinder) 9.13, 9.23, 9.33, respectively, which is in contact with the ink-collecting cylinder 9.5. As for the fourth inking device, it includes an ink duct 9.40, an additional inking roller 9.44, a pair of inking rollers 9.41 and a chablon cylinder 9.43, this latter cylinder being in contact with the plate cylinder 8. The additional ink roller 9.44 is necessary in this latter case as the fourth inking device 9.4 is used to directly ink the surface of the plate cylinder 8 which rotates in opposite direction as compared to the ink-collecting cylinder 9.5. As is usual in the art, the surface of the chablon cylinders 9.13, 9.23, 9.33 and 9.43 is structured so as to exhibit raised portions corresponding to the areas of the intaglio printing plates 8*a*, 8*b*, 8*c* intended to receive the inks in the corresponding colours supplied by the respective inking devices.

The ink wiping system 10, on the other hand, typically comprises a wiping tank 10.1, a wiping roller assembly 10.2 supported on and partly located in the wiping tank and contacting the plate cylinder 8, cleaning means 10.3 for removing wiped ink residues from the surface of the wiping roller assembly 10.2 using a wiping solution that is sprayed or otherwise applied onto the surface of the wiping roller assembly 10.2, and a drying blade 10.4 contacting the surface of the wiping roller assembly 10.2 for removing wiping solution residues from the surface of the wiping roller assembly 10.2. In the above known solution, as schematically illustrated in FIGS. 1 and 2, the entire wiping tank 10.1 together with the wiping roller assembly 10.2 is movable towards and away from the plate cylinder 8 (reference numeral 10' designating the ink wiping system 10 in a retracted maintenance position), removal of the wiping roller assembly 10.2 from the wiping tank 10.1 during maintenance operations being performed by means of a crane 12 that can be integrated in the press (as shown in FIGS. 1 and 2) or, alternatively, that is provided as separate handling equipment.

A particularly suitable solution for an ink wiping system comprising a wiping roller assembly is disclosed in International Application No. WO 2007/116353 A1 which is incorporated herein by reference in its entirety.

The most common solution used for wiping excess ink from the surface of an intaglio printing cylinder is, as discussed hereinabove, to use a wiping roller assembly that rotates in the same direction as the intaglio printing cylinder. Such wiping roller assembly typically consists of a cylinder base made commonly of metal and bearing at least one layer of wiping material, preferably a layer of polymer material such as PVC material. The structure and manufacture of such wiping roller assemblies is for instance disclosed in U.S. Pat. Nos. 3,785,286, 3,900,595, 4,054,685 and International Applications Nos. WO 2007/031925 A2, WO 2007/031927 A2, WO 2007/034362 A2 which are incorporated herein by reference.

As mentioned above, such wiping roller assembly is typically supported on and partly located in a wiping tank for rotation against the surface of the intaglio printing cylinder, the surface of the wiping roller assembly being cleaned from wiped ink residues using a wiping solution that is commonly sprayed onto the surface of the wiping roller assembly. It is to be understood that, in operation, the wiping roller assembly is supported in an upper section of the wiping tank so that a lower portion thereof can be sprayed with the wiping solution, used wiping solution being recovered in a lower section of the wiping tank.

With such known solutions, the wiping pressure between the intaglio printing cylinder and the wiping roller assembly is adjusted by playing with the position of the axis of rotation of the wiping roller assembly with respect to the axis of rotation of the intaglio printing cylinder. This is typically achieved by using two adjusting mechanisms acting on the two ends of the wiping roller assembly, such by means of eccentric bearings. Adjustment mechanisms for adjusting the wiping pressure between a wiping roller assembly and an intaglio printing cylinder are for instance disclosed in European Patent Applications Nos. EP 0 475 890 A1, EP 0 526 398 A1, and U.S. Pat. Nos. 2,987,993, 3,762,319. More recently, a solution has been proposed by the present Applicant with a view to allow selective adjustment of the wiping pressure at a plurality of locations along the contact portion between the wiping roller assembly and the intaglio printing cylinder. Such a solution is disclosed in greater detail in pending European patent applications Nos. EP 11166852.1 and EP 11166854.7 of May 20, 2011 both entitled "INK WIPING SYSTEM FOR AN INTAGLIO PRINTING PRESS".

Maintenance operations of the known ink wiping systems are time-consuming as the wiping roller assembly is a relatively heavy component to manipulate, which typically necessitates the use of a crane to remove the wiping roller assembly from the wiping tank as already mentioned. In addition, the use of a crane necessary implies that the wiping roller assembly is extracted from or lowered onto the wiping tank along a substantially vertical trajectory, which in turn necessitates movement of the entire wiping tank, including the wiping roller assembly, to a retracted maintenance position (as for instance indicated by reference numeral 10' in FIGS. 1 and 2) away from the intaglio printing cylinder in order to create a sufficient distance between the intaglio printing cylinder and the wiping roller assembly. This substantially complicates the overall construction of the ink wiping system and the coupling thereof to the corresponding wiping solution supply and treatment system. This further requires a robust and stable interlocking mechanism to properly secure the wiping tank onto the machine frame during printing operations, which requirement is exacerbated by the fact that the wiping roller assembly which is supported on the wiping tank is subjected to considerable mechanical constraints during printing operations.

An improved solution is thus required.

SUMMARY OF THE INVENTION

A general aim of the invention is therefore to provide an improved ink wiping system for use in an intaglio printing press as compared to the solutions already known in the art.

A further aim of the invention is to provide such an ink wiping system that facilitates maintenance operations, in particular cleaning of the ink wiping system.

Yet another aim of the invention is to provide such an ink wiping system that allows an easy and quick exchange of a used wiping roller assembly by a new wiping roller assembly.

These aims are achieved thanks to the ink wiping system defined in the claims.

According to a first aspect of the invention, there is accordingly provided an ink wiping system of an intaglio printing press comprising a wiping tank and a rotatable wiping roller assembly supported on and partly located in the wiping tank for wiping excess ink from the surface of a rotatable intaglio printing cylinder of the intaglio printing press, the ink wiping system comprising a wiping roller retracting device which forms an integral part of the ink wiping system and is adapted to be coupled to the wiping roller assembly to move the wiping roller assembly between a working position where the wiping roller assembly is supported on and partly located in the wiping tank for cooperation with the intaglio printing cylinder and a parking position where the wiping roller assembly is retracted out of the wiping tank and away from the intaglio printing cylinder, wherein, in the working position of the wiping roller assembly, the wiping roller retracting device is coupled to the wiping roller assembly. According to this first aspect of the invention, the ink wiping system includes, at the parking position, a storage section adapted to receive the wiping roller assembly which is retracted by the wiping roller retracting device.

Such an ink wiping system greatly facilitates maintenance operations in that the wiping roller assembly can simply be retracted to the parking position by means of the wiping roller retracting device, thereby freeing and allowing full access to the wiping tank for cleaning purposes. Once the cleaning operations have been completed, the wiping roller assembly can be moved back to its working position.

The storage section can advantageously be located immediately below the wiping tank, which ensures a very compact configuration and allows unobstructed access to the wiping tank.

In an advantageous variant, the wiping roller retracting device can be adapted to release the wiping roller assembly in the parking position. In such a context, the storage section is preferably provided with a wiping roller holding device adapted to hold the wiping roller assembly in the parking position upon release by the wiping roller retracting device, which wiping roller holding device may advantageously comprise first and second arms adapted to be brought into cooperation with a respective one of first and second extremities of the wiping roller assembly.

According to a preferred variant of this first aspect of the invention, the ink wiping system further comprises an interlocking mating guide designed to guide and position a trolley with respect to the ink wiping system and along a path of the wiping roller retracting device, the trolley being designed to allow exchange of a used wiping roller assembly by a new wiping roller assembly. Advantageously, the wiping roller retracting device is adapted to release the used wiping roller assembly in the parking position, prior to coupling of a trolley to the interlocking mating guide and the storage section is provided with means for transferring the used wiping roller assembly from the storage section onto the trolley coupled to the interlocking mating guide.

According to a second aspect of the invention (which second aspect can be implemented in combination with the above first aspect as mentioned above) there is provided an ink wiping system of an intaglio printing press comprising a wiping tank and a rotatable wiping roller assembly supported on and partly located in the wiping tank for wiping excess ink from the surface of a rotatable intaglio printing cylinder of the intaglio printing press, the ink wiping system comprising a wiping roller retracting device which forms an integral part of the ink wiping system and is adapted to be coupled to the wiping roller assembly to move the wiping roller assembly between a working position where the wiping roller assembly is supported on and partly located in the wiping tank for cooperation with the intaglio printing cylinder and at least one retracted position where the wiping roller assembly is retracted out of the wiping tank and away from the intaglio printing cylinder, wherein, in the working position of the wiping roller assembly, the wiping roller retracting device is coupled to the wiping roller assembly. According to this second aspect of the invention, the ink wiping system further comprises an interlocking mating guide designed to guide and position a trolley with respect to the ink wiping system and along a path of the wiping roller retracting device, which trolley is designed to allow exchange of a used wiping roller assembly by a new wiping roller assembly.

Such an ink wiping system likewise greatly facilitates maintenance operations in that a used wiping roller assembly can simply be transferred onto a trolley coupled to the interlocking mating guide, while a new wiping roller assembly can be transferred from a trolley coupled to the interlocking mating guide to the working position. It will become apparent from the following description that one and a same trolley can be used to transport the new wiping roller assembly to the ink wiping system and evacuate the used wiping roller assembly, in which case the aforementioned storage section can be exploited as temporary storage area (see illustrations of FIGS. 5A to 5J). In another embodiment, a trolley can be used to evacuate the used wiping roller assembly, and the same trolley (once freed from the used wiping roller assembly) or another empty trolley can be used to transport a new wiping roller assembly to the ink wiping system (see illustrations of FIGS. 4A to 4L).

In an advantageous variant, the wiping roller retracting device can be adapted to move and release the used wiping roller assembly directly onto a trolley coupled to the interlocking mating guide.

In yet another advantageous variant, the wiping roller retracting device can be adapted to take up the new wiping roller assembly sitting on a trolley coupled to the interlocking mating guide and move the new wiping roller assembly directly from the trolley to the working position.

In an advantageous embodiment of the invention, the wiping roller retracting device is adapted to pivot the wiping roller assembly away from and to the working position. In this context, the wiping roller retracting device may advantageously comprise first and second rotatable supporting arms adapted to be coupled at one end to a respective one of first and second extremities of the wiping roller assembly. The wiping roller retracting device is preferably pivotally supported onto the wiping tank.

In yet another advantageous embodiment, the wiping tank can be fixedly secured to a machine frame of the intaglio printing press and be unable to move with respect to the machine frame, which solution allows for a highly robust ink wiping system configuration.

There is further provided an intaglio printing press comprising an ink wiping system as provided above.

Further advantageous embodiments of the ink wiping system form the subject-matter of the dependent claims and are discussed below.

BRIEF DESCRIPTION OF THE DRAWINGS

Other features and advantages of the present invention will appear more clearly from reading the following detailed description of embodiments of the invention which are presented solely by way of non-restrictive examples and illustrated by the attached drawings in which.

DETAILED DESCRIPTION OF EMBODIMENTS OF THE INVENTION

Within the scope of the present invention, the expression "intaglio printing cylinder" designates either a cylinder whose surface is provided with intaglio patterns engraved directly onto the circumference of the cylinder or a plate cylinder carrying on its circumference at least one intaglio printing plate with engraved intaglio patterns (the second solution being now more common in the art). In the following description, it will be assumed for the sake of illustration that the intaglio printing cylinder is a plate cylinder carrying several intaglio printing plates on its circumference.

Figure 3:
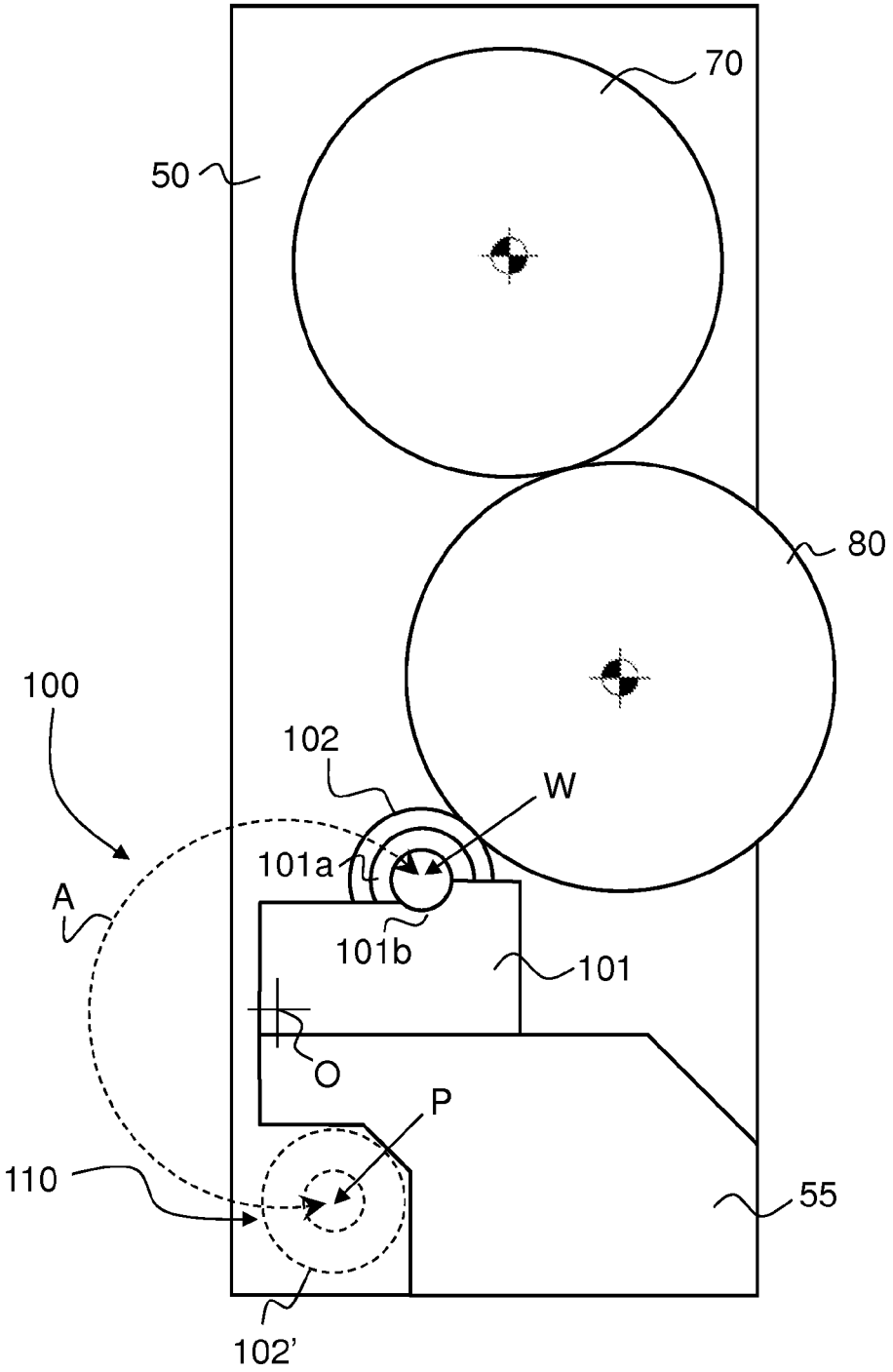
FIG. 3 is a schematic side view of an ink wiping system according to a first aspect of the invention.

FIG. 3 is a schematic partial side view of an ink wiping system according to a first aspect of the invention. In FIG. 3, reference numeral 50 designates one of a pair of side frames supporting the impression cylinder 70 and intaglio printing cylinder 80, while reference numeral 55 designates a wiping tank support supporting the wiping tank 101 of the ink wiping system 100. The side frames 50 and the wiping tank support 55 are secured to one another and jointly form parts of the machine frame of the intaglio printing press. The wiping tank 101 is preferably fixedly secured to the machine frame 50, 55 (the wiping tank 101 being unable to move with respect to the machine frame), in contrast to the known solutions discussed in the preamble hereof.

Also shown in FIG. 3 is the wiping roller assembly 102 that is supported on and partly located in the wiping tank 101, the wiping roller assembly 102 being supported at both ends thereof by way of corresponding wiping roller bearings 101*a*, 101*b* provided on the wiping tank 101. As is usual in the art, such wiping roller bearings 101*a*, 101*b* are typically designed as eccentric bearings adapted to selectively allow the wiping roller assembly 102 to be brought in contact with the intaglio printing cylinder 80 (or interrupt such contact if required) and allow adjustment of the wiping pressure. Such bearings 101*a*, 101*b* are commonly made in two parts, the upper part 101*a* being adapted to be disengaged from the lower part 101*b* (whether manually or semi-automatically) for the purpose of removing the wiping roller assembly from the wiping tank 101.

According to the invention, the ink wiping system 100 comprises a wiping roller retracting device (not specifically illustrated in FIG. 3 but designated by reference numeral 150 in FIGS. 4A-4L and 5A-5J) which forms an integral part of the ink wiping system 100 and is adapted to be coupled to the wiping roller assembly 102 to move the wiping roller assembly 102 between a working position W where the wiping roller assembly 102 is supported on and partly located in the wiping tank 101 for cooperation with the intaglio printing cylinder 80, as illustrated, and a parking position P where the wiping roller assembly 102 is retracted out of the wiping tank 101 and away from the intaglio printing cylinder 80. The ink wiping system 100 includes, at the parking position P, a storage section 110 adapted to receive the wiping roller assembly 102 that is retracted by the wiping roller retracting device. In FIG. 3, the wiping roller assembly retracted to the parking position P is depicted in dashed lines and designated by reference numeral 102'.

Figure 1:
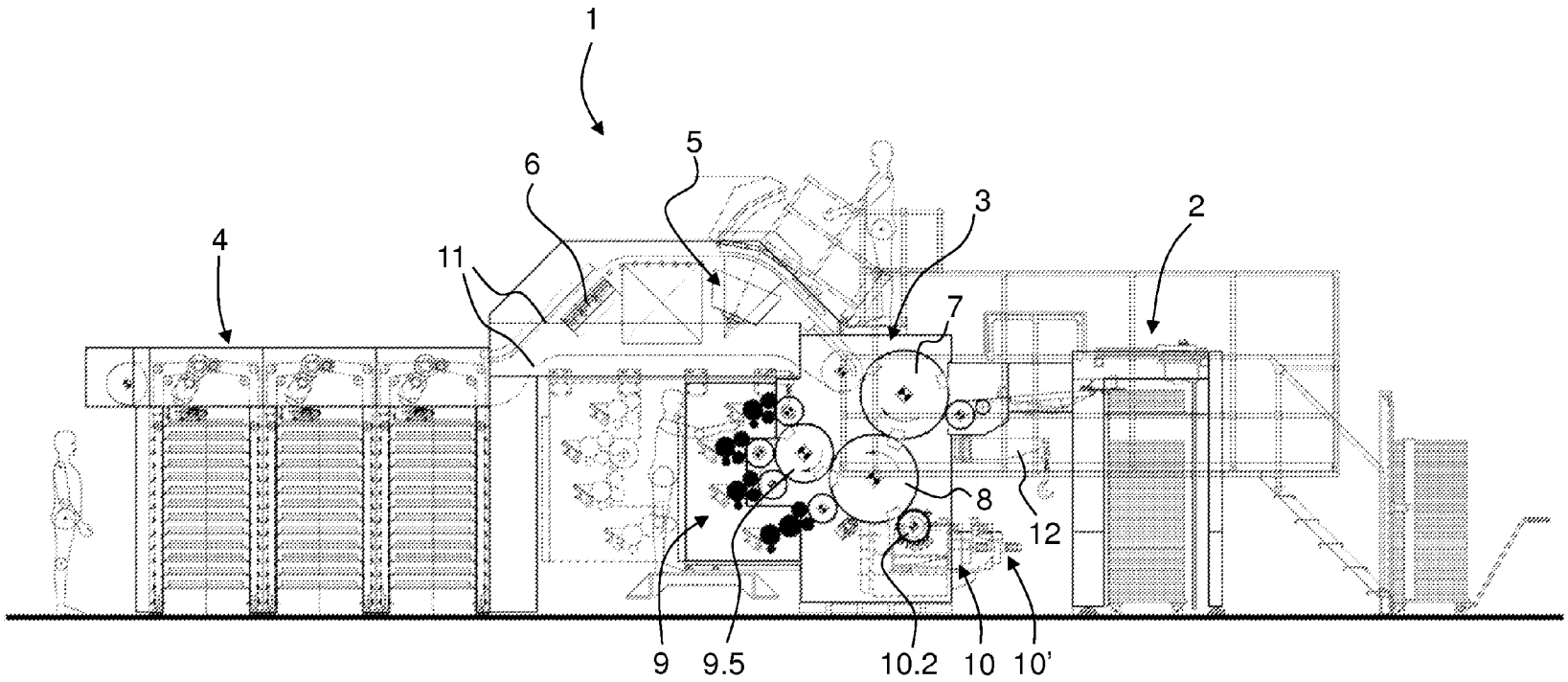
Fig. 1 (PRIOR ART)
FIG. 1 is a side-view of a known intaglio printing press.
Figure 2:
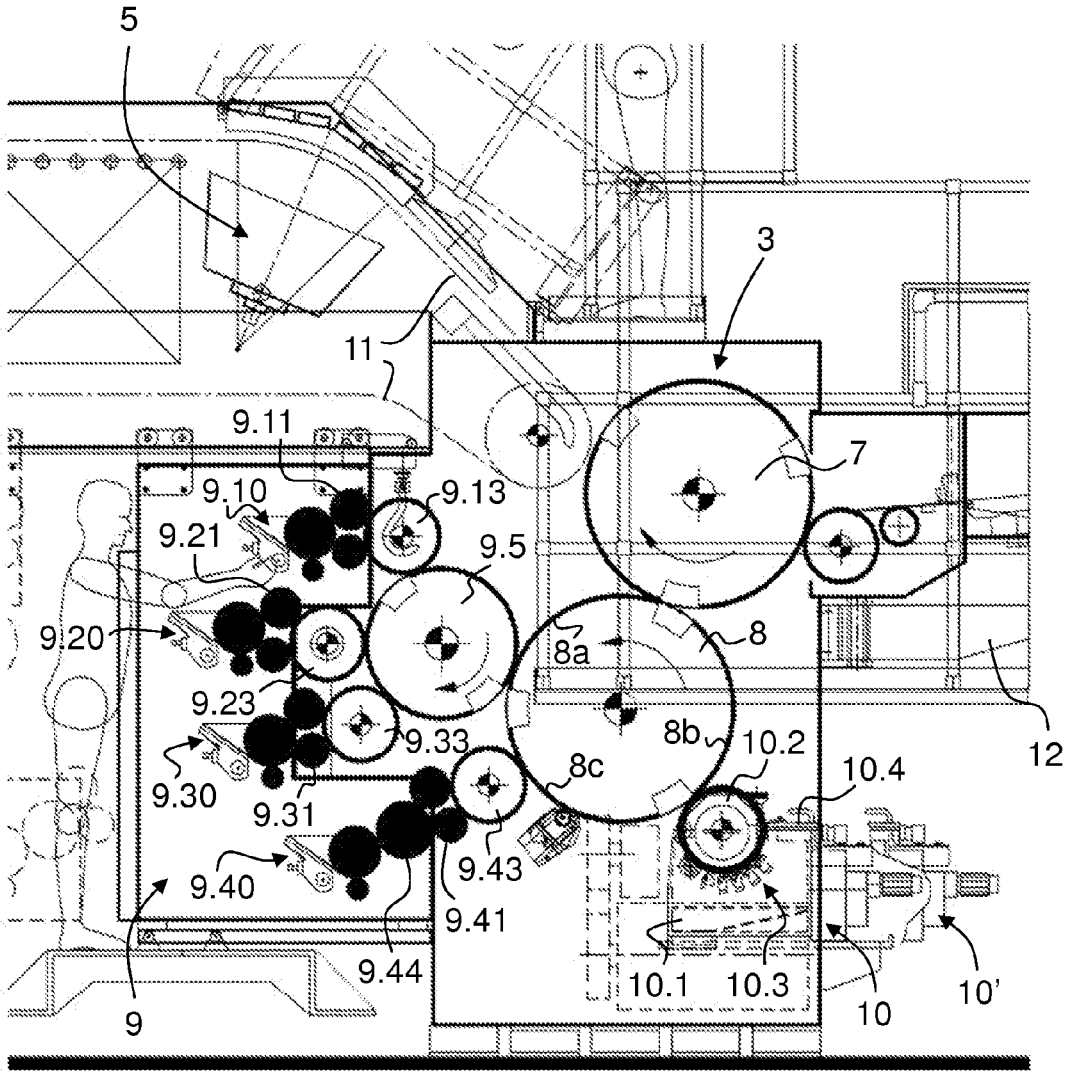
Fig. 2 (PRIOR ART)
FIG. 2 is an enlarged side view of the intaglio printing unit of the intaglio printing press of FIG. 1.

According to the invention, it shall be appreciated that, in the working position of the wiping roller assembly, the wiping roller retracting device (which is an integral part of the ink wiping system) is coupled to the wiping roller assembly. This contrasts with the known solution discussed in the preamble hereof, where a separate crane is only coupled to the wiping roller assembly during maintenance operations, which maintenance operations require retraction of the entire wiping tank to a maintenance position (as pictured in FIGS. 1 and 2) before the crane can get hold of the wiping roller assembly.

Preferably, as schematically illustrated in FIG. 3, movement between the working position W and the parking position P is carried out by pivoting the wiping roller assembly 102 as depicted by the trajectory designated by reference A. In the illustrated example, the storage section 110 is advantageously located immediately below the wiping tank 101, the pivoting movement A between the working position W and the parking position P covering an angle of slightly more than 180°. In the context, the wiping roller retracting device can be pivotally supported onto the wiping tank 101 as schematically illustrated by the axis of rotation O in FIG. 3.

Movement of the wiping roller assembly 102 between the working position W and the parking position P is preferably done via a suitable drive, such as an electric motor, servomotor or the like, or an adequate pneumatic or hydraulic system.

The wiping tank 101 is typically provided with adequate means designed to remove and clean the surface of the wiping roller assembly 102 from wiped ink residues. This can advantageously be carried out by means of a system as disclosed in International Application No. WO 2007/116353 A1 which is incorporated herein by reference in its entirety.

FIGS. 4A to 4L are schematic partial perspective views of an ink wiping system 100' according to a further embodiment of the invention, which perspective views illustrate successive states of the ink wiping system 100' in the course of maintenance operations where a used wiping roller assembly 102 is replaced by a new wiping roller assembly 102*.

Reference numerals 50 and 55 in FIGS. 4A-4L again respectively designate a pair of side frames and a wiping tank support jointly forming part of a machine frame of the intaglio printing press. It is again to be understood that the pair of side frames 50 in particular supports the impression cylinder and intaglio printing cylinder (not shown) of the intaglio printing press, while the wiping tank support 55 is fixedly secured to the side frames 50 and supports the wiping tank 101 of the ink wiping system 100'. Reference numeral 51 in FIGS. 4A-4L further designates an upright which supports or is part of the feeder (not shown in FIGS. 4A-4L) feeding the sheets to the printing group of the intaglio printing press.

Figure 4A:
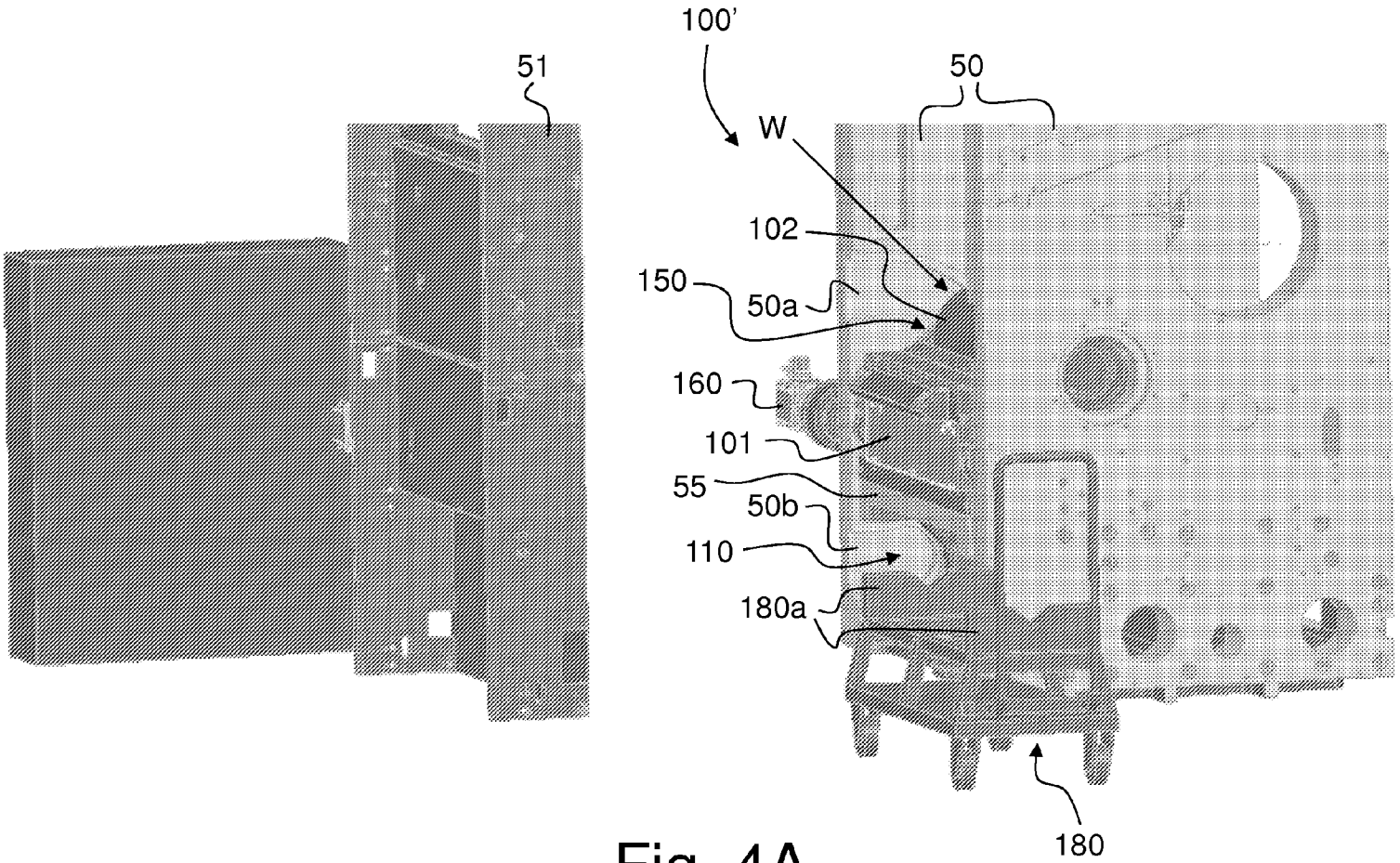
FIGS. 4A to 4L are schematic partial perspective views of an ink wiping system according to a further embodiment of the invention, which views illustrate successive states of the ink wiping system in the course of maintenance operations where a used wiping roller assembly is replaced by a new wiping roller assembly.

FIG. 4A illustrates a wiping roller assembly 102 located in the working position W, i.e. with the wiping roller assembly 102 being supported on and partly located in the wiping tank 101 (as also schematically shown in FIG. 3).

The embodiment of FIGS. 4A-4L further shows the wiping roller retracting device 150 which consists in this example of a pair of rotatable supporting arms 151, 152 adapted to be coupled at one end to a respective one of first and second extremities of the wiping roller assembly 102. The wiping roller retracting device 150 is adapted to operate according to the principle of FIG. 3, i.e. the wiping roller retracting device 150 is adapted to pivot the wiping roller assembly 102 away from and to the working position W. This wiping roller retracting device 150 is advantageously supported pivotally onto the wiping tank 101, driving of the wiping roller retracting device 150 being preferably ensured by a suitable drive 160, such as an electric motor.

If required, the wiping roller retracting device 150 can be operated to at least temporarily move the wiping roller assembly 102 to a storage section 110 that is advantageously provided immediately below the wiping tank 101.

In the illustrated example, it is to be understood that the two rotatable supporting arms 151, 152 are adapted to move, perpendicularly to the axis of rotation of the wiping roller assembly 102, with corresponding spaces provided between the side frames 50 and the lateral side walls of the wiping tank 101. As shown in FIGS. 4A-4L, channels or grooves 50*a*, 50*b* are further formed in the vicinity of the working position W and of the storage section 110 along the path of the rotatably supporting arms 151, 152 and of the extremities of the wiping roller assembly 102.

One will now describe operation of the wiping roller retracting device 150 in case of replacement of a used wiping roller assembly by a new wiping roller assembly. For the sake of explanation, the used wiping roller assembly will be designated in FIGS. 4A-4L by reference numeral 102, while the new wiping roller assembly will be designated by reference numeral 102*.

In the context of FIGS. 4A-4L, it will further be understood that at least one trolley, designated by reference numeral 180, is used for the purpose of exchanging the wiping roller assembly. As illustrated, this trolley 180 is designed to be guided and positioned with respect to the ink wiping system 100' by means of an interlocking mating guide 115 (see FIG. 4G) supported at a lower portion of the ink wiping system 100' between the side frames 50. The trolley 180 further comprises a support portion 180*a* designed to receive the used wiping roller assembly 102 that is removed by the wiping roller retracting device 150 and to support the new wiping roller assembly 102*.

Figure 4B:
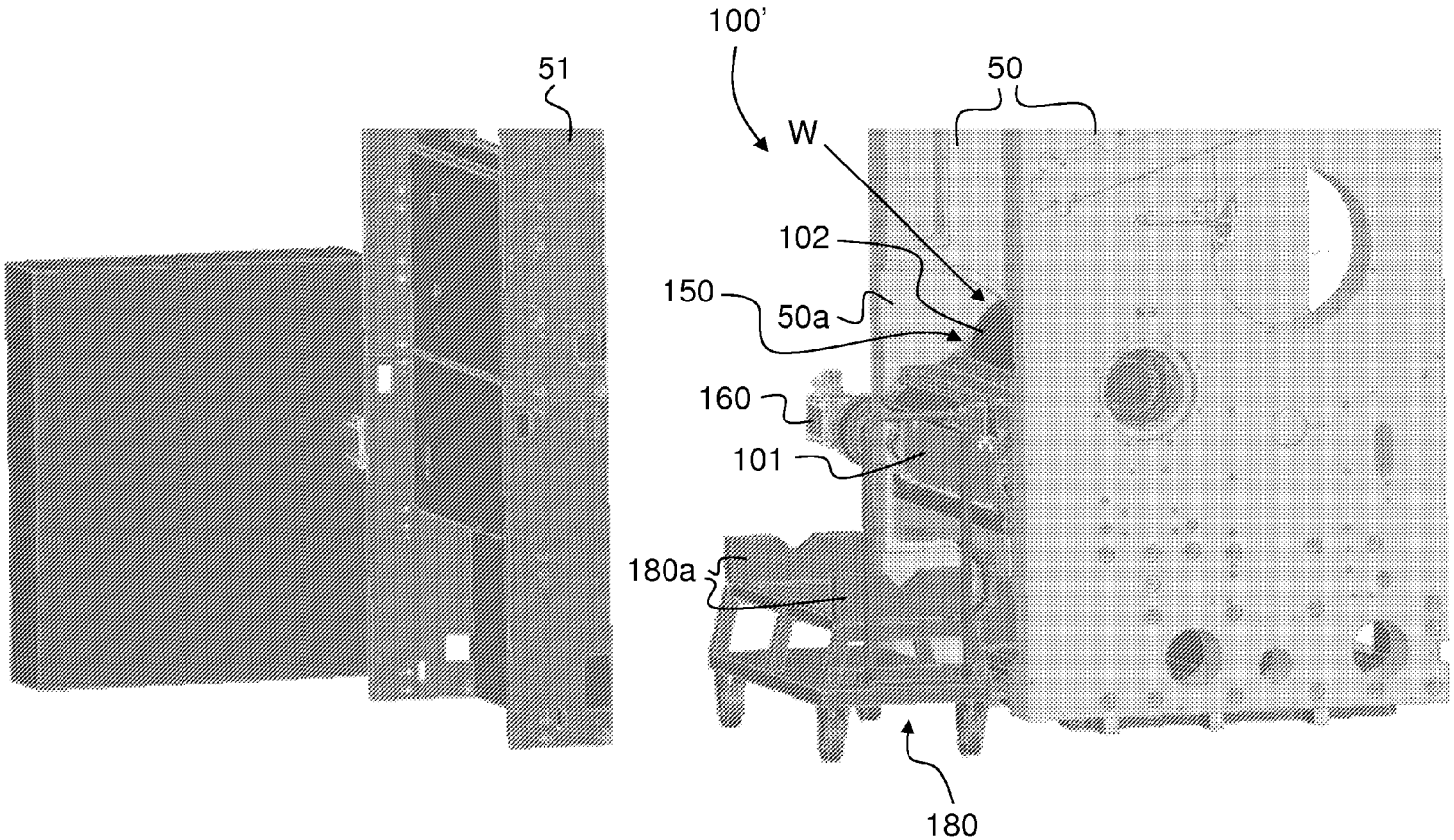

FIGS. 4A and 4B illustrate the steps whereby the trolley 180 is brought in front of the ink wiping system 100' and guided onto the interlocking mating guide 115 so as to be positioned with respect to the ink wiping system 100' along the path of the wiping roller retracting device 150. In this example, the ink wiping system 100' and trolley 180 are arranged so as to allow the wiping roller retracting device 150 to move and release the used wiping roller assembly 102 directly onto the trolley 180 that is coupled to the interlocking mating guide 115.

Before actuating the wiping roller retracting device 150, the wiping roller assembly 102 is uncoupled from the various functional components that are typically associated to operation of the wiping roller assembly 102 during printing operations. Such functional components, which are not specifically illustrated, including in particular a wiping roller drive for driving the wiping roller assembly 102 into rotation and a thermoregulation unit for regulating the temperature of the wiping roller assembly 102. In the context of the present invention, it suffices to understand that suitable coupling systems are provided to ensure that the wiping roller drive and thermoregulation unit can be uncoupled from and coupled to the wiping roller assembly 102 (whether manually or semi-automatically).

Figure 4C:
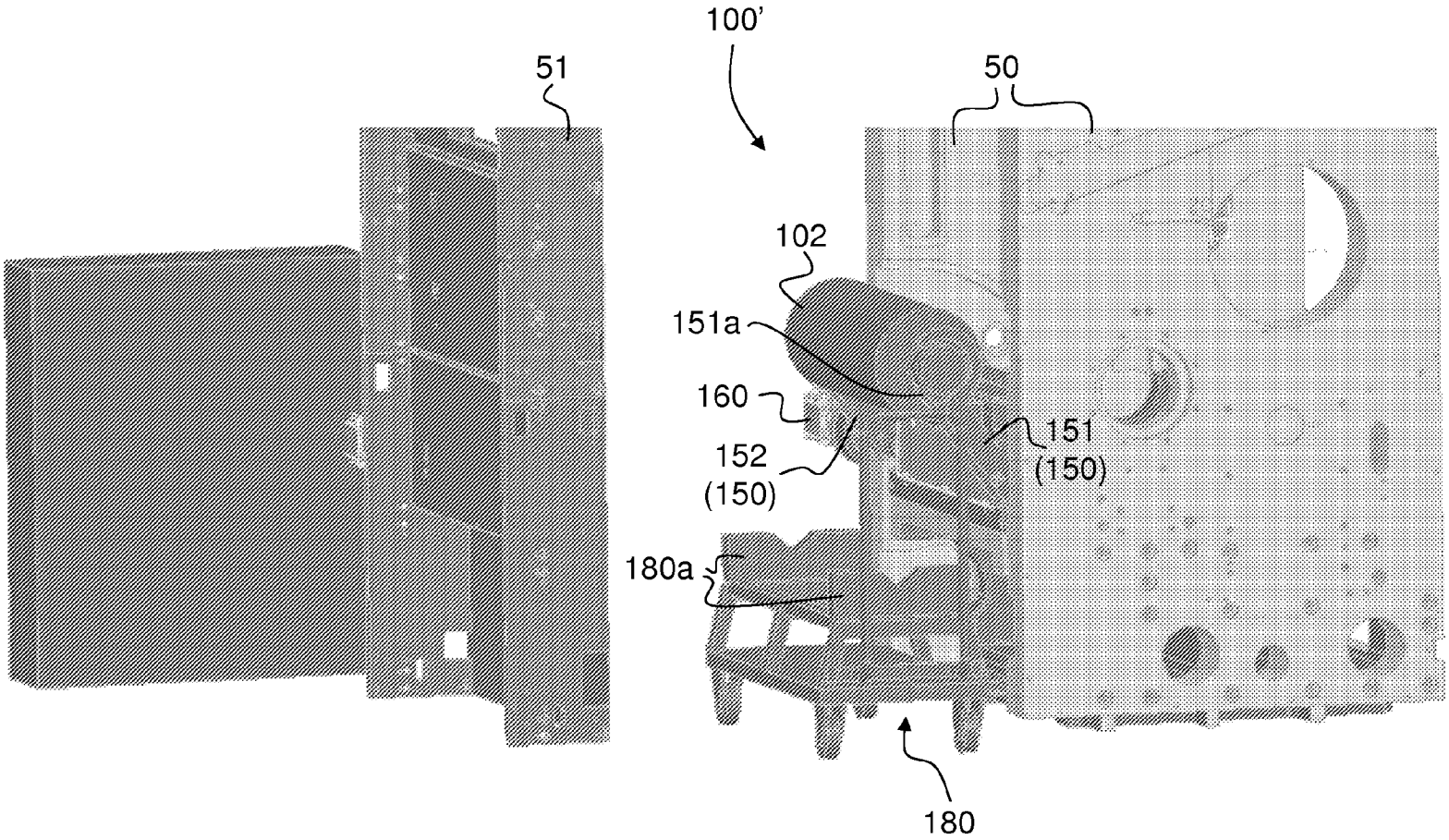
Figure 4D:
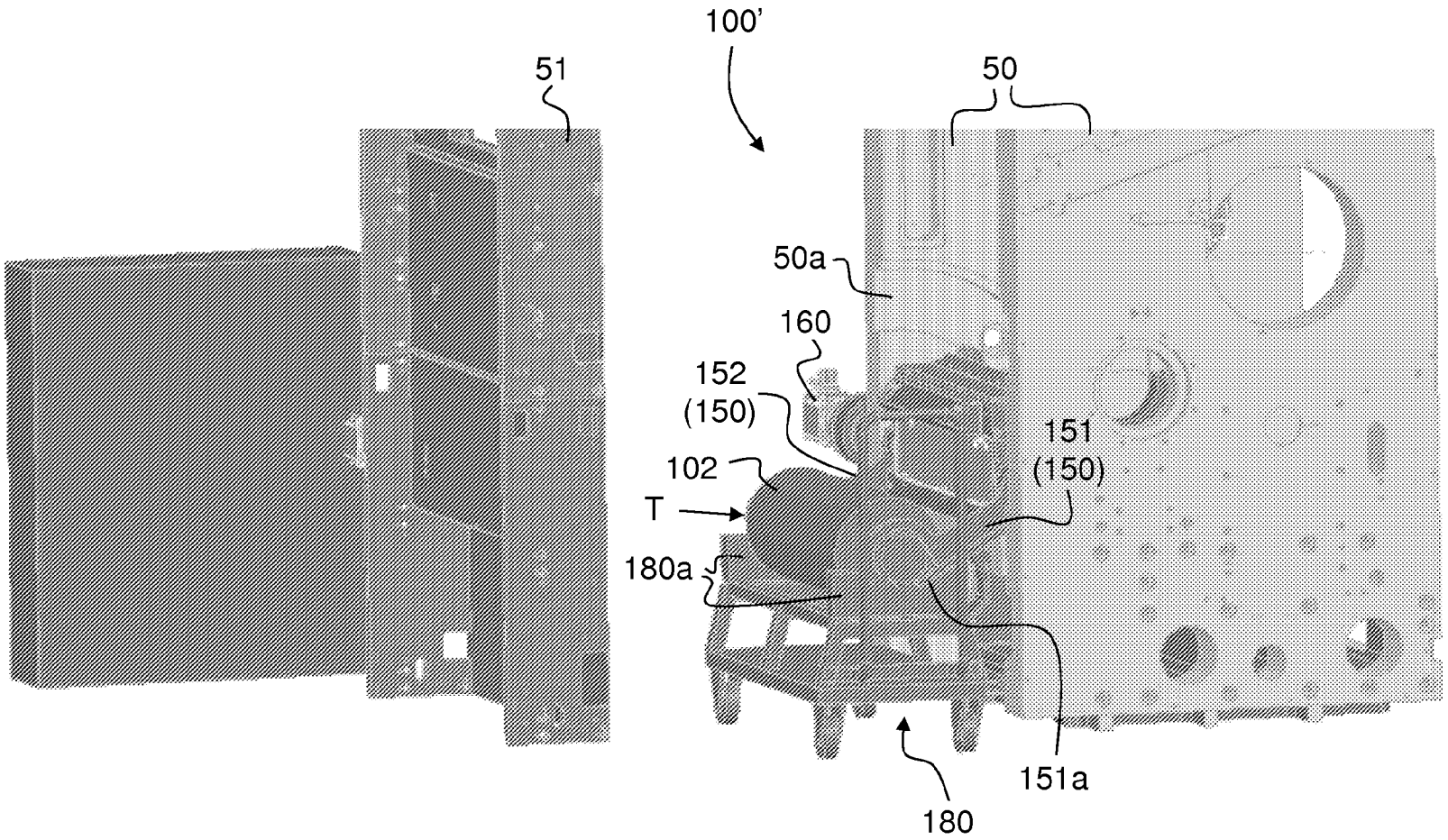

FIGS. 4C and 4D illustrate the ink wiping system 100' in states where the used wiping roller assembly 102 is being moved by the wiping roller retracting device 150 away from the working position W and onto the support portion 180*a* of the trolley 180. Both supporting arms 151, 152 of the wiping roller retracting device 150 cooperate with and are coupled at one end to a respective one of first and second extremities of the wiping roller assembly 102. As schematically illustrated, each supporting arm 151, 152 comprises a movable retaining section 151*a*, respectively 152*a*, which, when located in a closed position as illustrated in FIGS. 4C and 4D, ensures that the corresponding extremity of the wiping roller assembly 102 is properly secured onto the corresponding supporting arm 151, 152.

Once the used wiping roller assembly 102 has been moved to the position where it rests onto the support portion 180*a* of the trolley 180 (which position is designated by reference T in FIG. 4D), the movable retaining sections 151*a*, 152*a* of the supporting arms 151, 152 can be moved to an open position thereby freeing the extremities of the wiping roller assembly 102 and releasing the wiping roller assembly 102 onto the trolley 180.

Figure 4E:
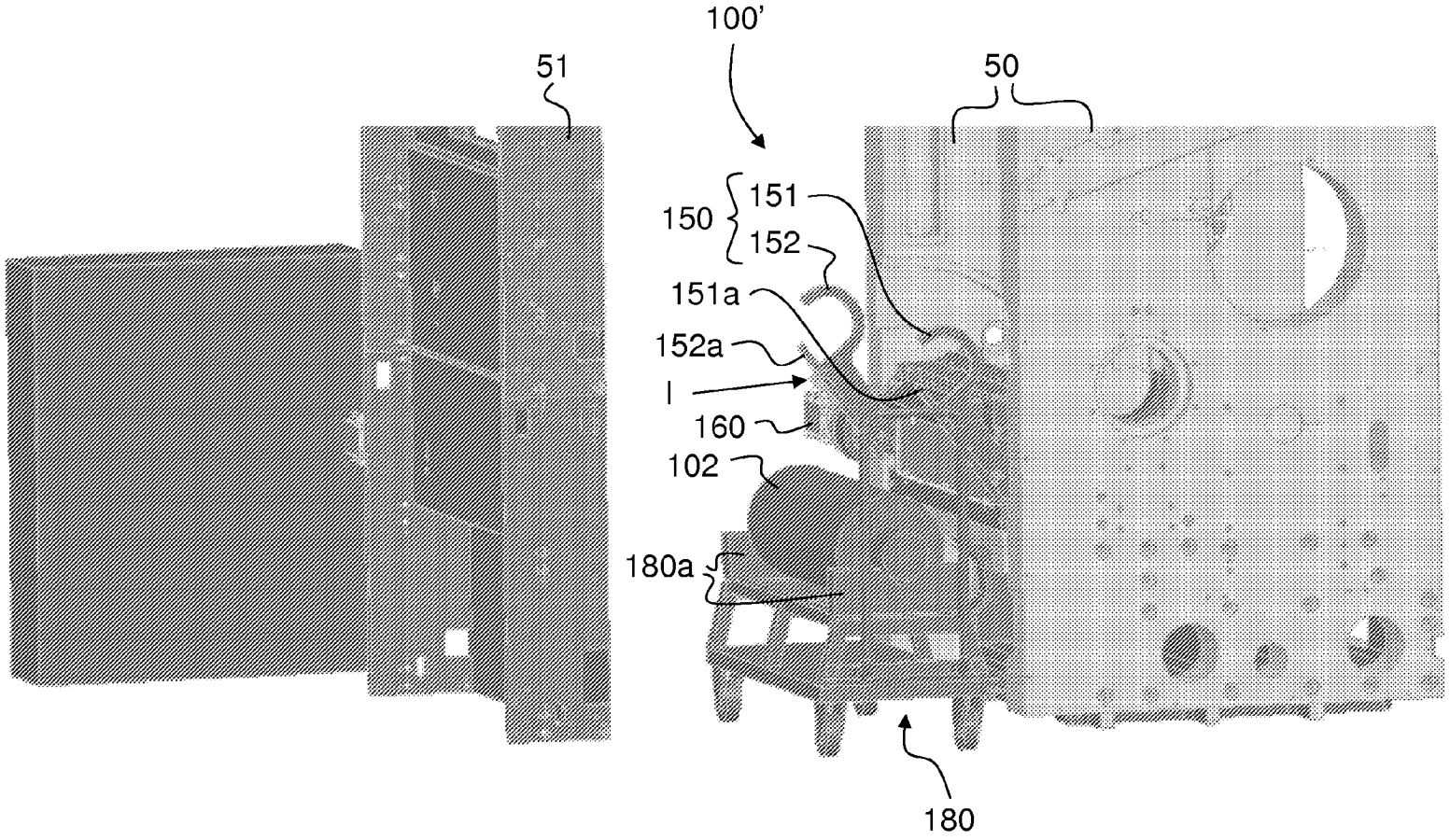
Figure 4F:
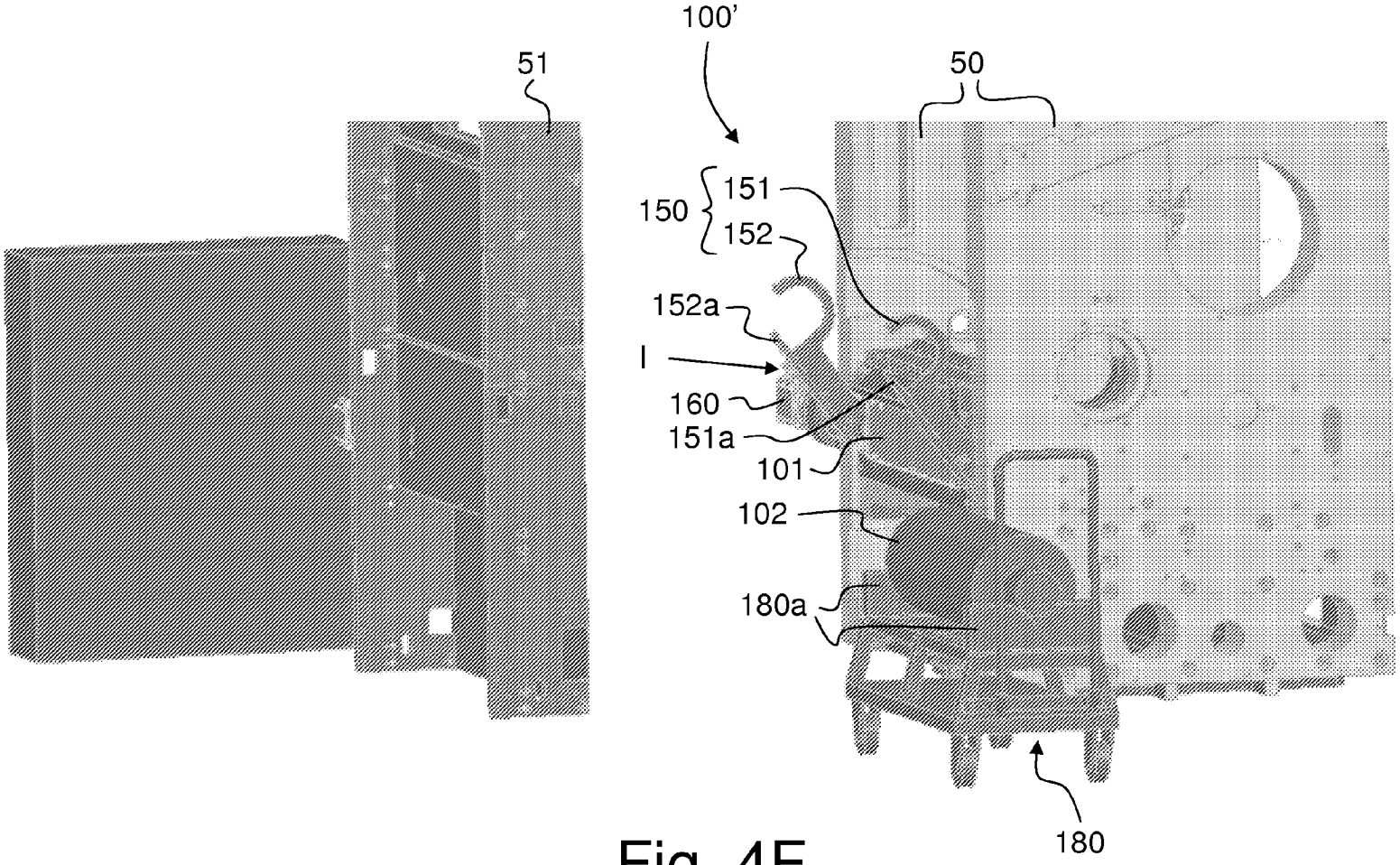
Figure 4G:
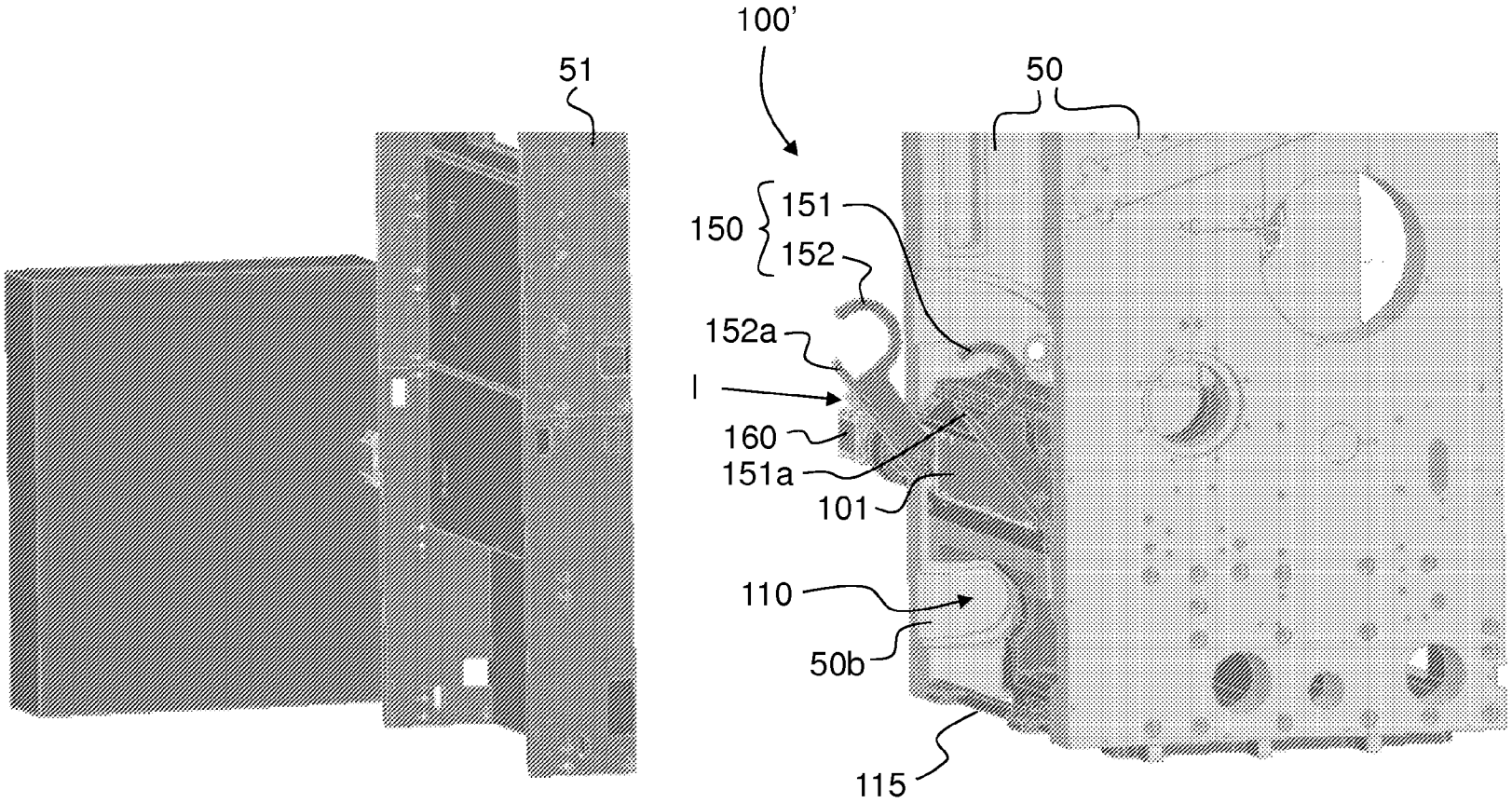
Figure 4H:
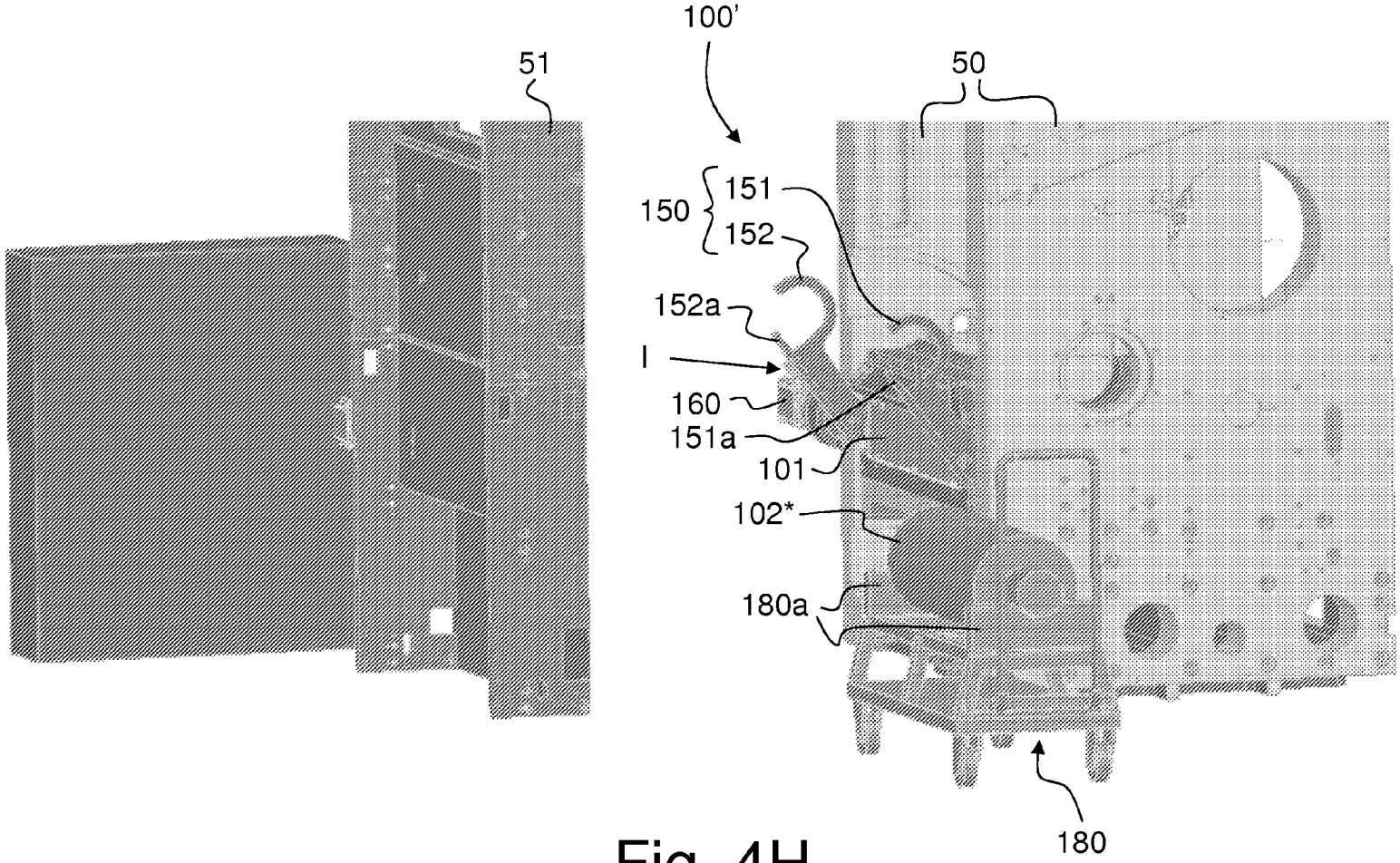
Figure 4I:
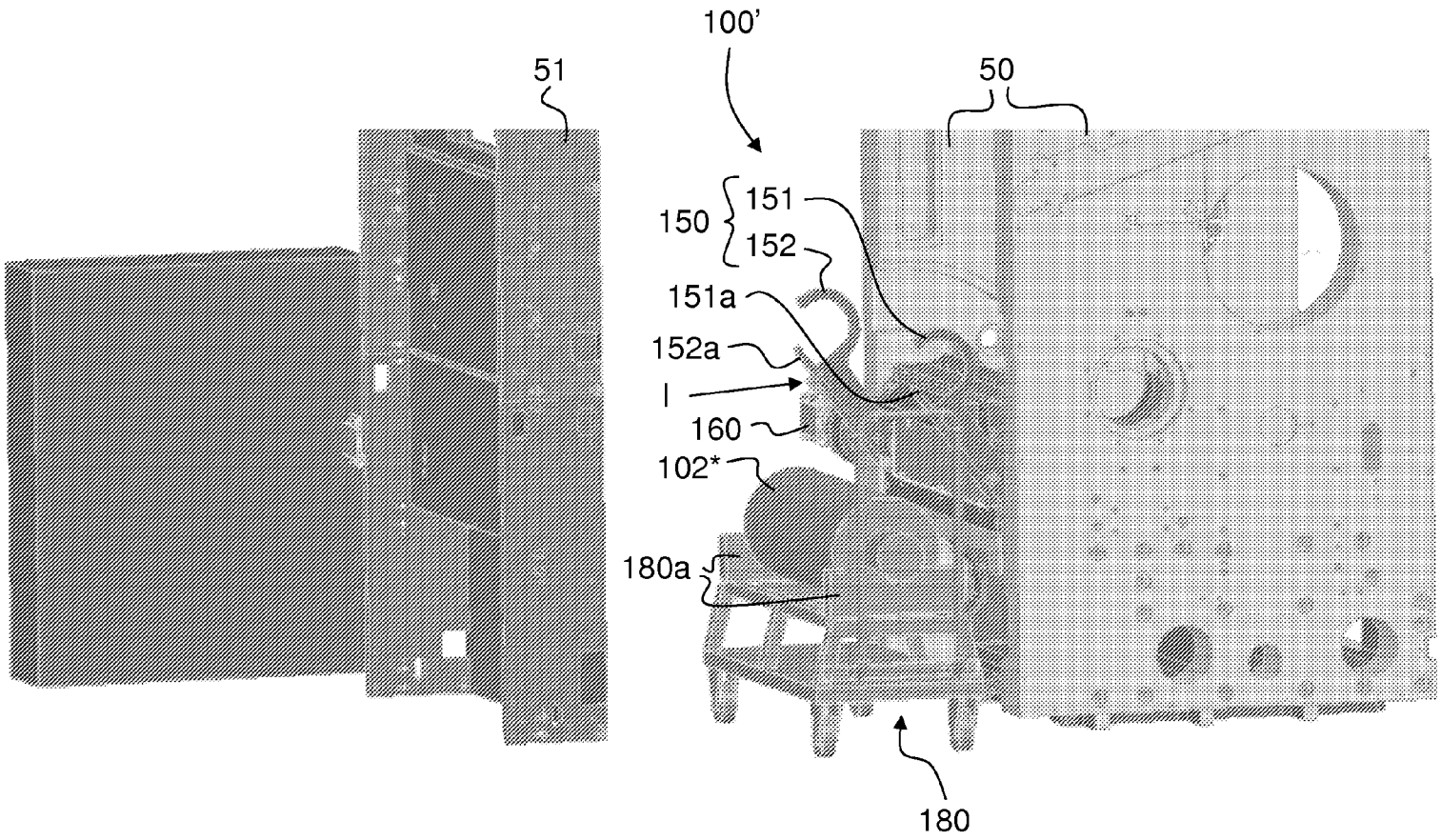
Figure 4J:
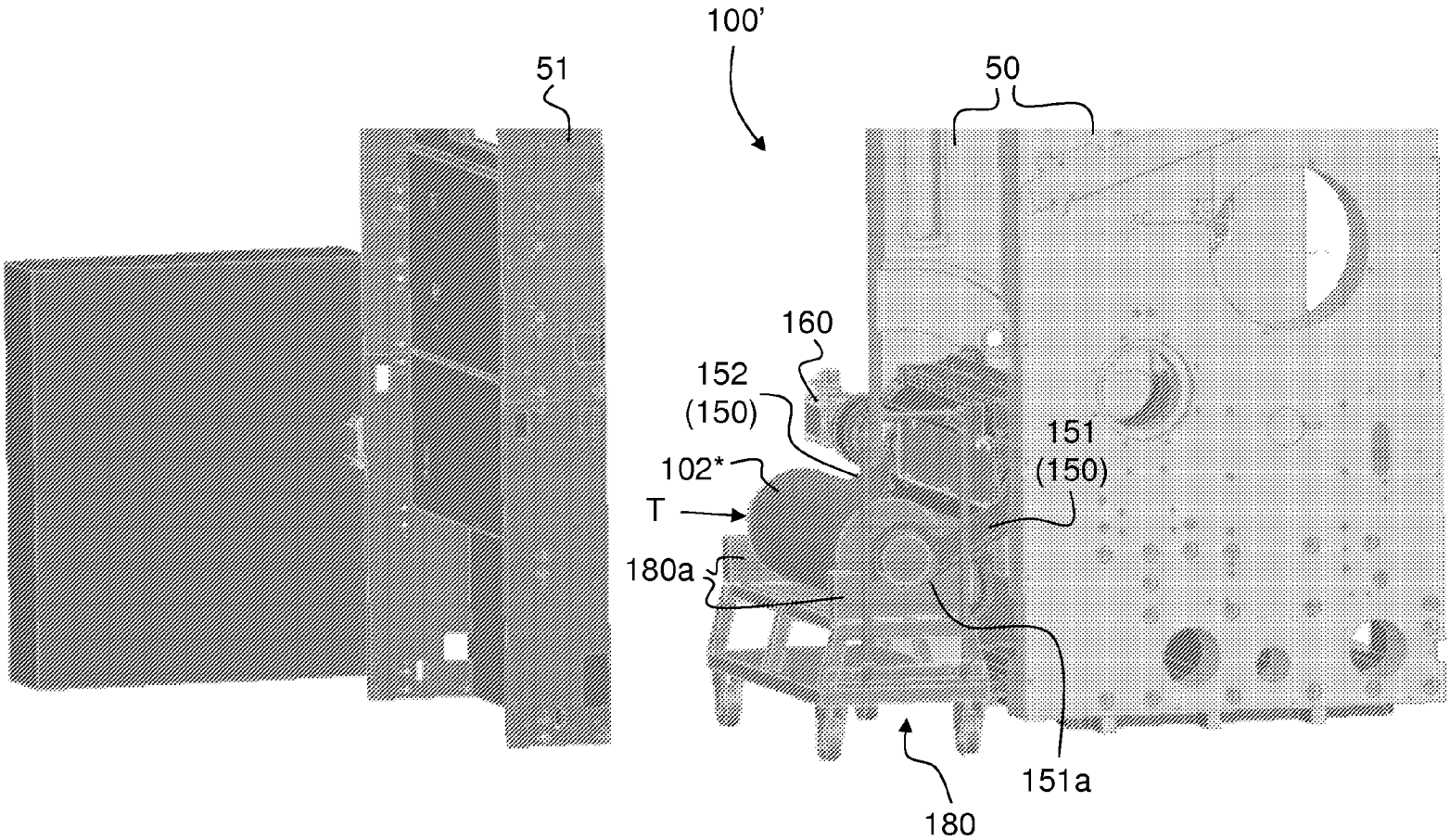
Figure 4K:
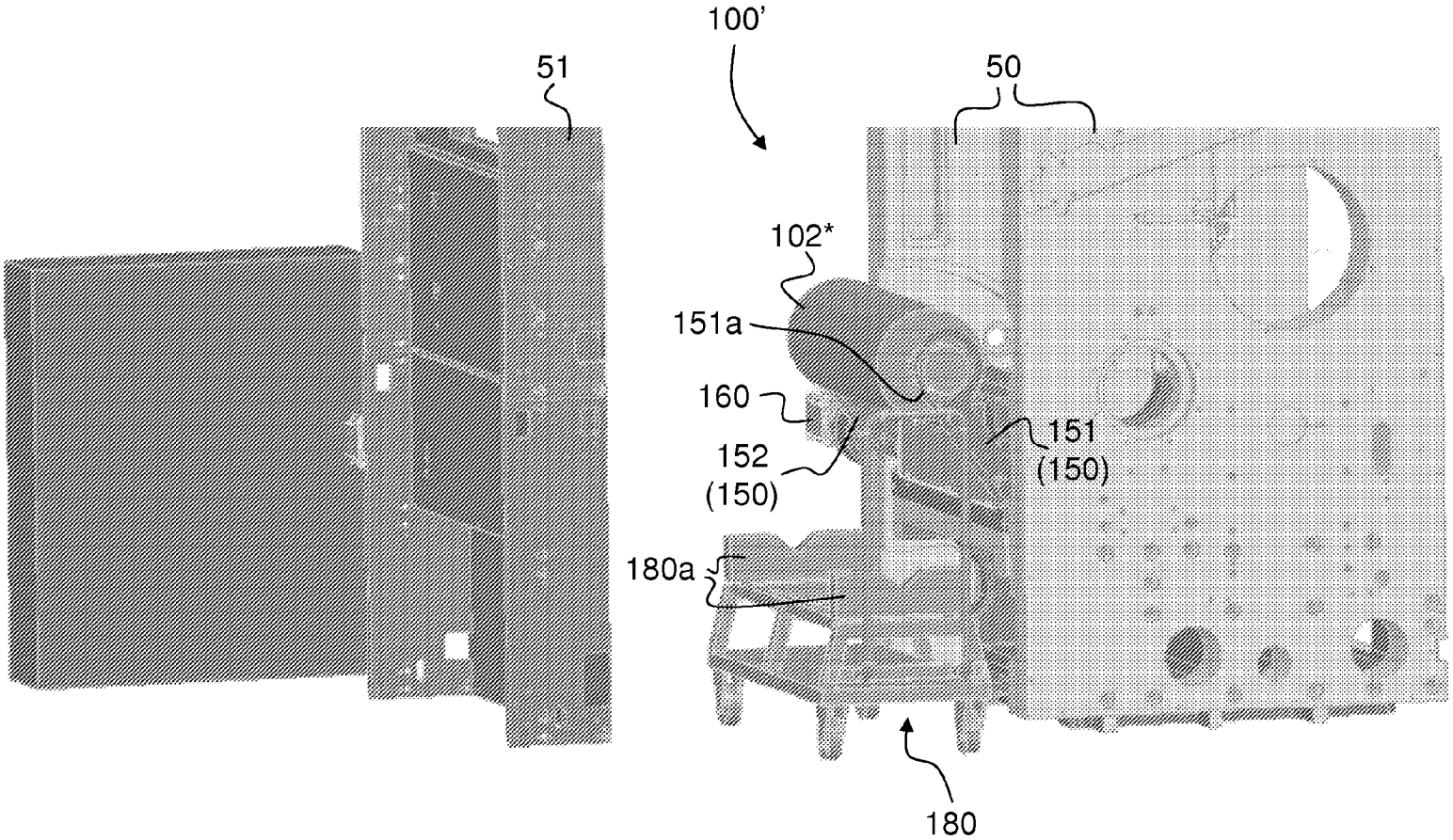
Figure 4L:
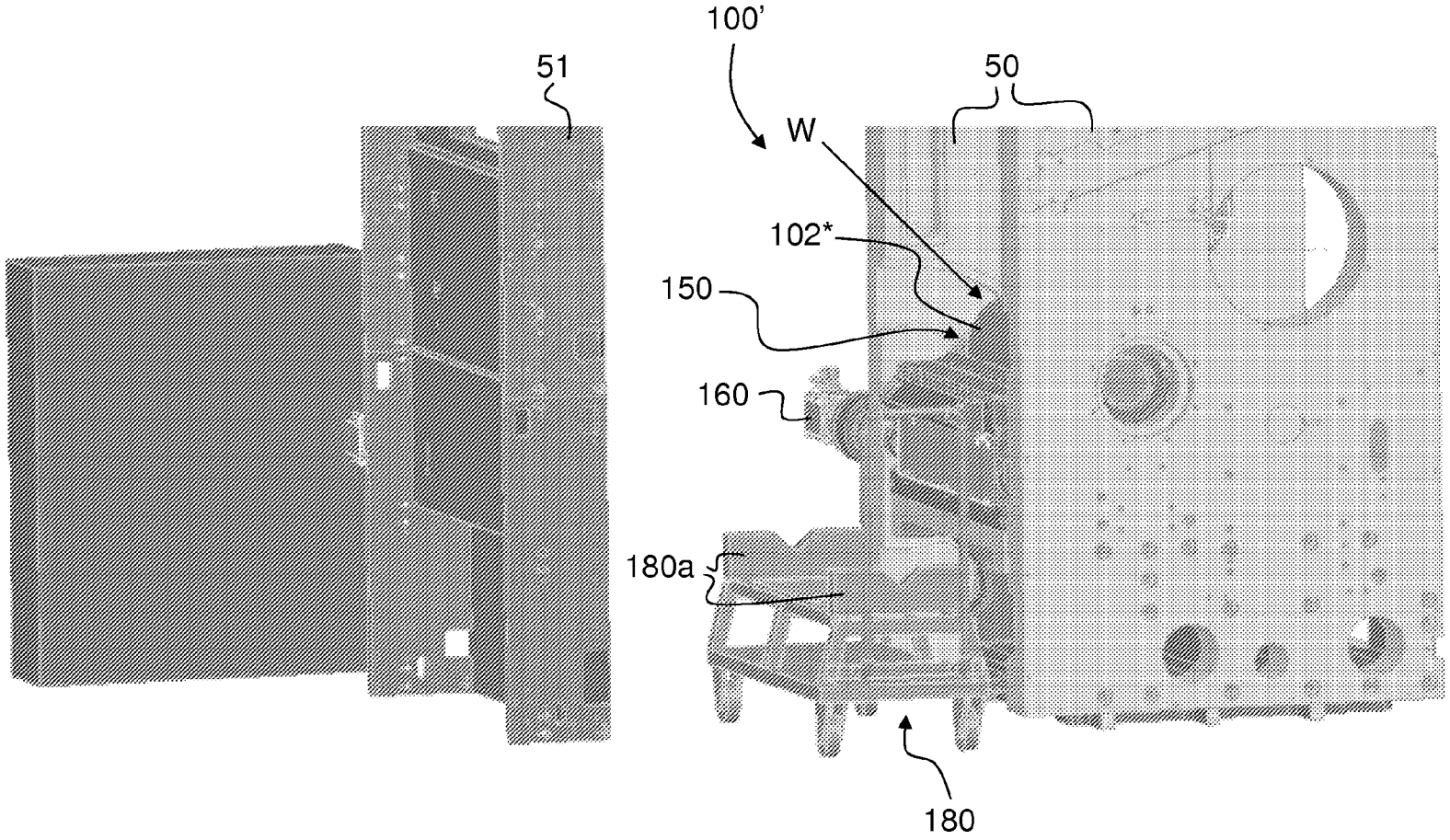

Once the wiping roller assembly 102 has been released onto the trolley 180, the supporting arms 151, 152 are moved to an intermediate position I as illustrated in FIG. 4E. The used wiping roller assembly 102 can then be evacuated by means of the trolley as illustrated by FIGS. 4F and 4G.

A new wiping roller assembly 102* can then be brought to the ink wiping system 100' which has been freed from the used wiping roller assembly 102, as illustrated by FIGS. 4H to 4L. Installation of the new wiping roller assembly 102* is carried out by performing the same operations as discussed above in relation to FIGS. 4A to 4F, in reversed order, namely by first coupling the trolley 180 with the new wiping roller assembly 102* to the interlocking mating guide 115 (FIGS. 4H and 4I), by moving the supporting arms 151, 152 to position T and coupling these arms 151, 152 to both extremities of the new wiping roller assembly 102* (FIG. 4J), by moving the supporting arms 151, 152 with the new wiping roller assembly 102* back to the working position W (FIGS. 4K and 4L), and then evacuating the empty trolley 180.

FIGS. 5A to 5J are schematic partial perspective views of an ink wiping system 100" according to another embodiment of the invention, which perspective views again illustrate successive states of the ink wiping system 100" in the course of maintenance operations where a used wiping roller assembly 102 is replaced by a new wiping roller assembly 102*.

The ink wiping system 100" of FIGS. 5A-5J shares a number of components which are identical to those of the ink wiping system 100' of FIGS. 4A-4L. Components identified in FIGS. 5A to 5J by the same reference numerals as in FIGS. 4A to 4L will not be described again, it being for instance to be appreciated that the wiping roller retracting device 150 illustrated in FIGS. 5A to 5J is structurally the same as the one illustrated in FIGS. 4A to 4L.

The difference between the ink wiping system 100" of FIGS. 5A-5J and the ink wiping system 100' of FIGS. 4A-4L, resides in the fact that, in the embodiment of FIGS. 5A-5J, the wiping roller assembly can be released in the parking position P (i.e. in the storage section 110 provided immediately below the wiping tank 101 in the illustrated example), the storage section 110 being advantageously provided with a wiping roller holding device, generally designated by reference numeral 170, which is adapted to hold the wiping roller assembly in the parking position P upon release by the wiping roller retracting device 150.

In addition, a different trolley is used in this other embodiment, namely a trolley, designated by reference numeral 200, which comprises upper and lower support portions 200*a* and 200*b* for supporting the wiping roller assembly (see FIGS. 5D to 5J).

Figure 5A:
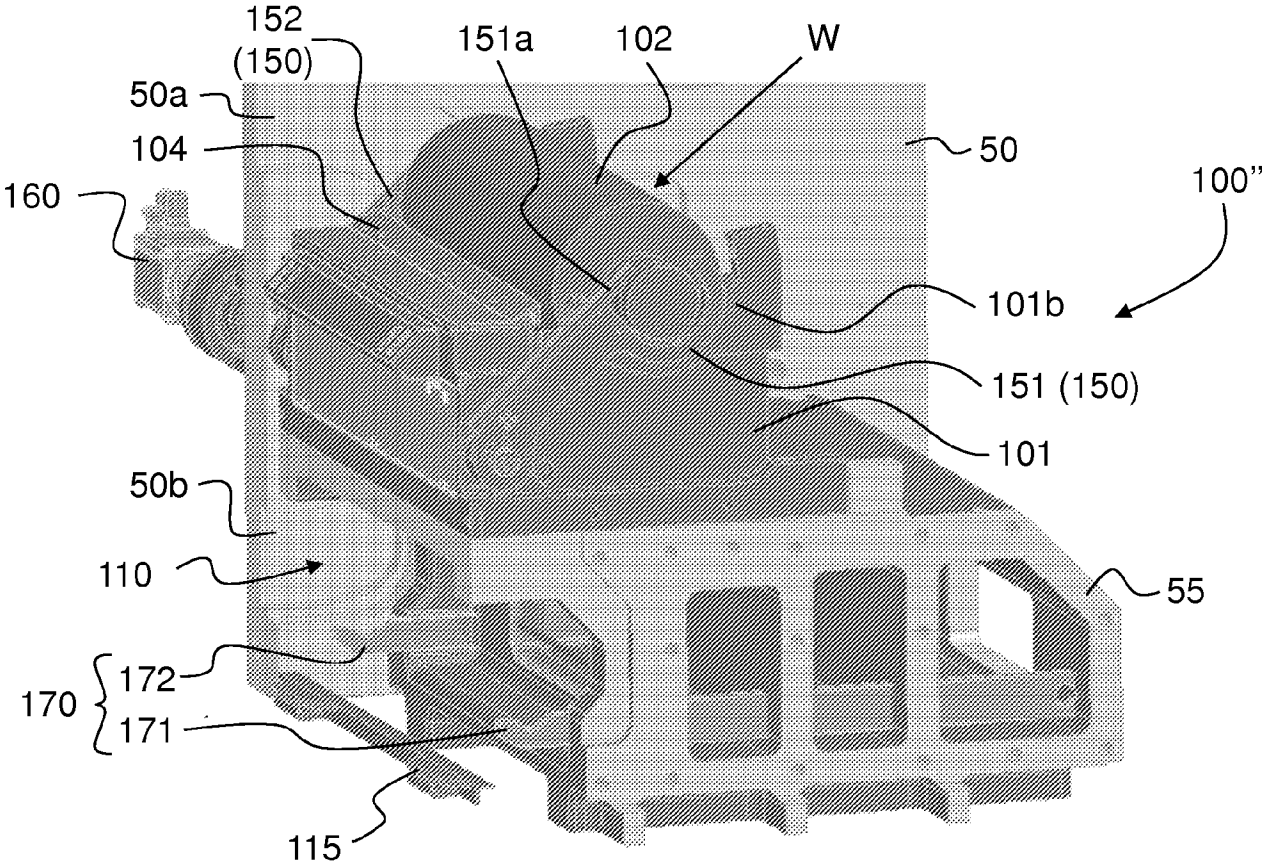
FIG. 5A to 5J are schematic partial perspective views of an ink wiping system according to yet another embodiment of the invention, which views again illustrate successive states of the ink wiping system in the course of maintenance operations where a used wiping roller assembly is replaced by a new wiping roller assembly.
Figure 5B:
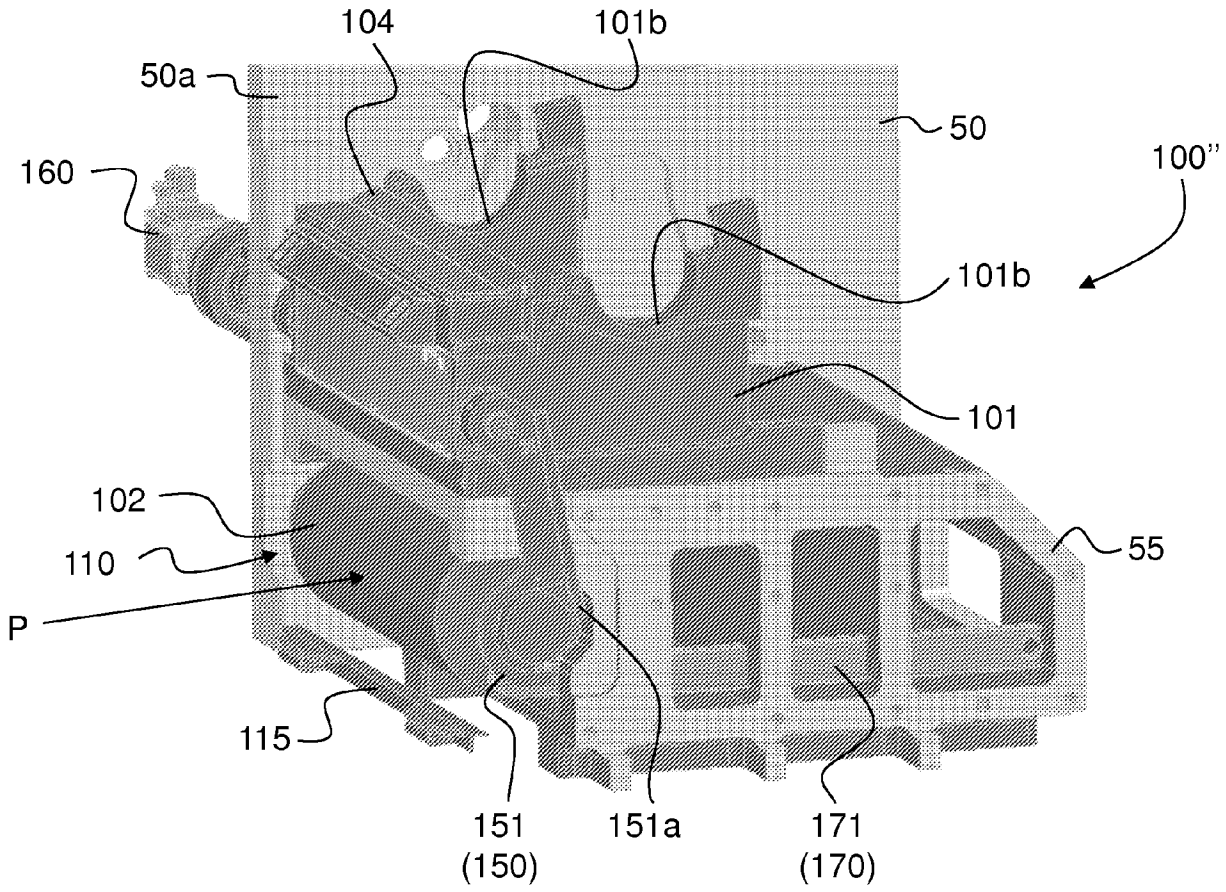
Figure 5C:
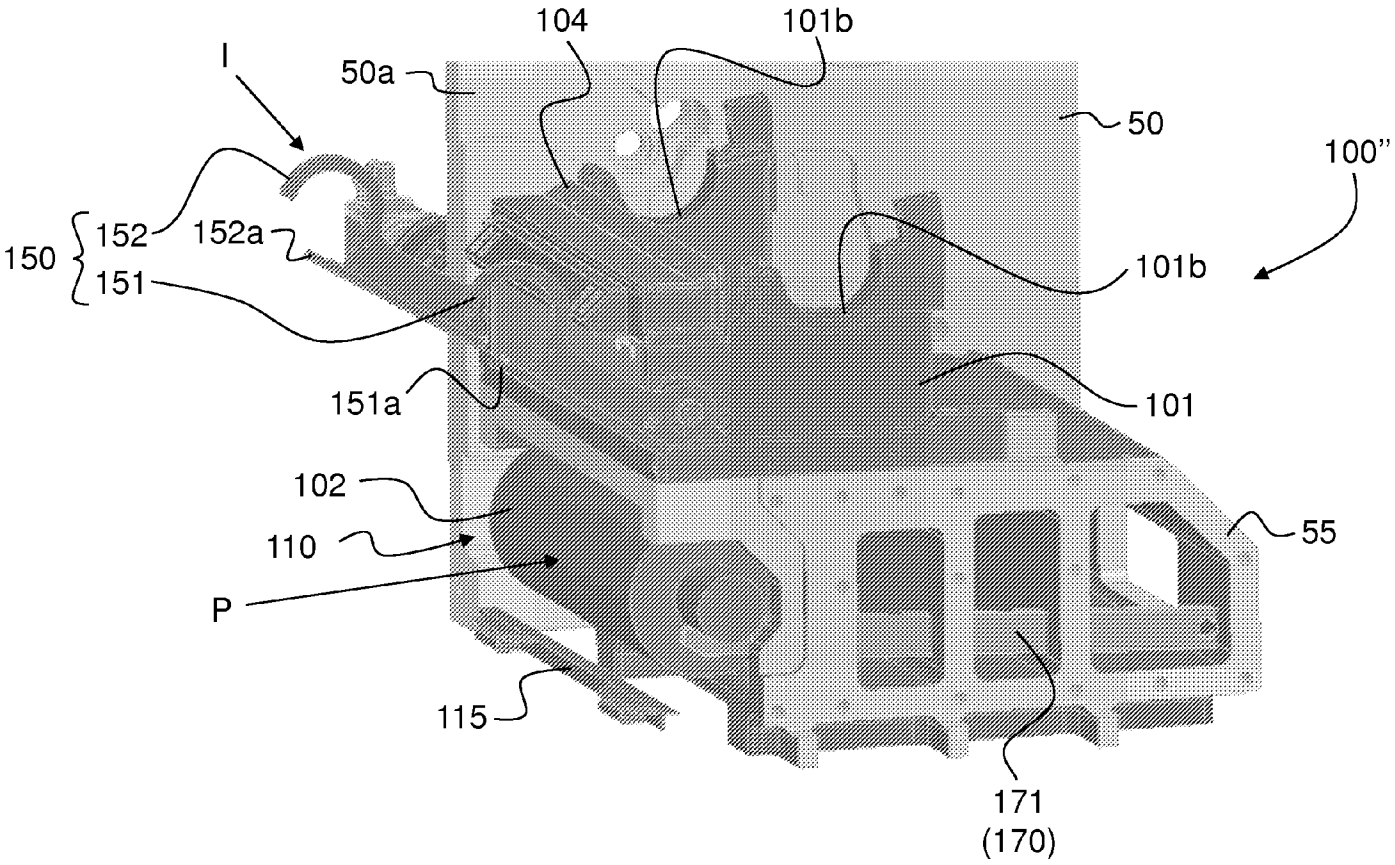

FIG. 5A shows a used wiping roller assembly 102 in the working position W (one of the side frames 50 having been omitted in FIGS. 5A-5J for the sake of illustration).

In this other example, the used wiping roller assembly 102 is first moved to the parking position P by means of the wiping roller retracting device 150 (see FIG. 5B) in order to be released in the storage section 110. Before being released by the wiping roller retracting device 150, the wiping roller holding device 170 is actuated to support the used wiping roller assembly 102. In this example, the wiping roller holding device 170 comprises a pair of supporting arms 171, 172 that are adapted to be brought into cooperation with a respective one of the extremities of the wiping roller assembly 102. Once the wiping roller assembly 102 is properly held by the wiping roller holding device 170, the arms 151, 152 of the wiping roller retracting device 150 can be uncoupled from the wiping roller assembly 102 and moved to an intermediate position I (see FIG. 5C).

Figure 5D:
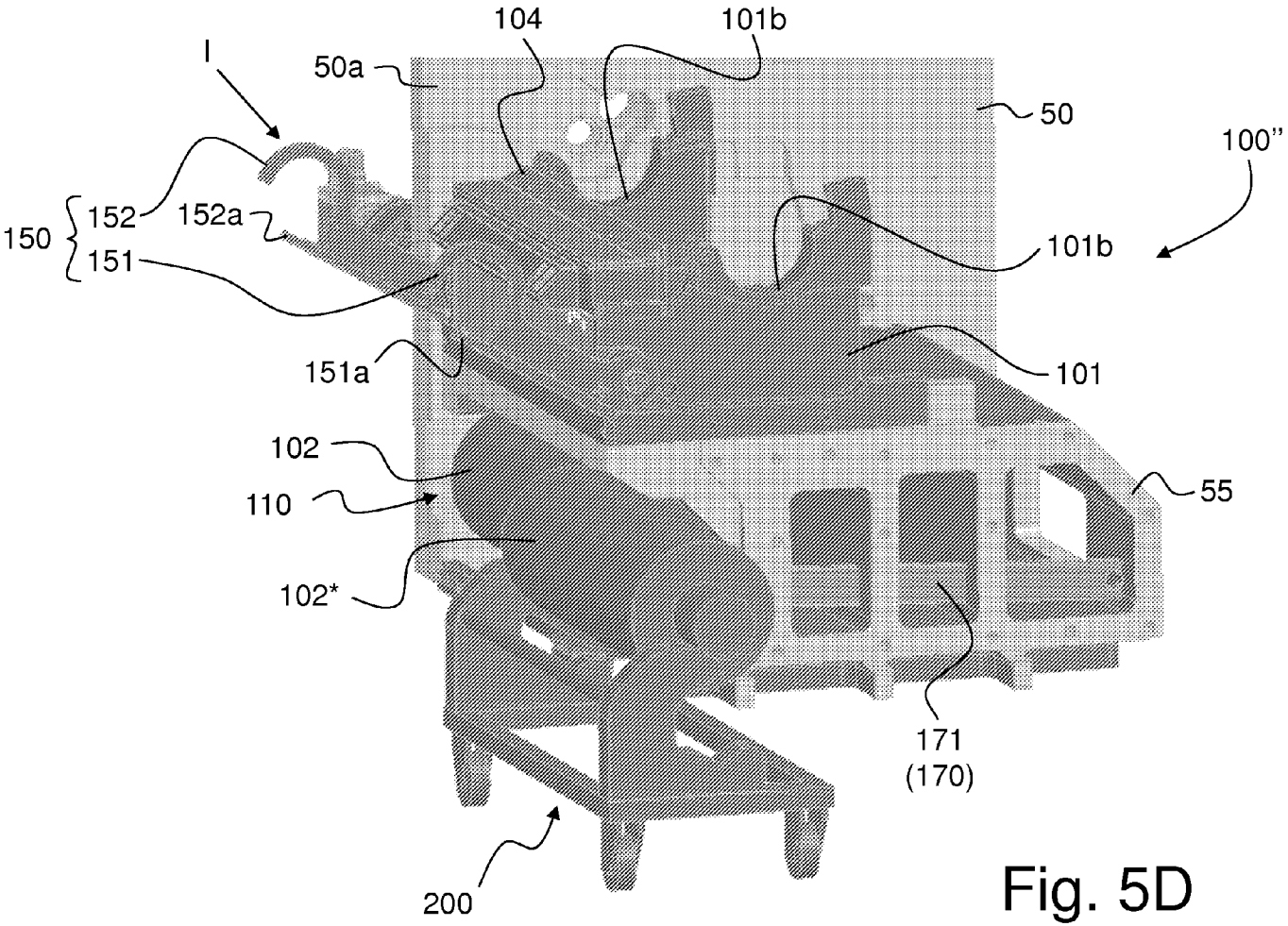
Figure 5E:
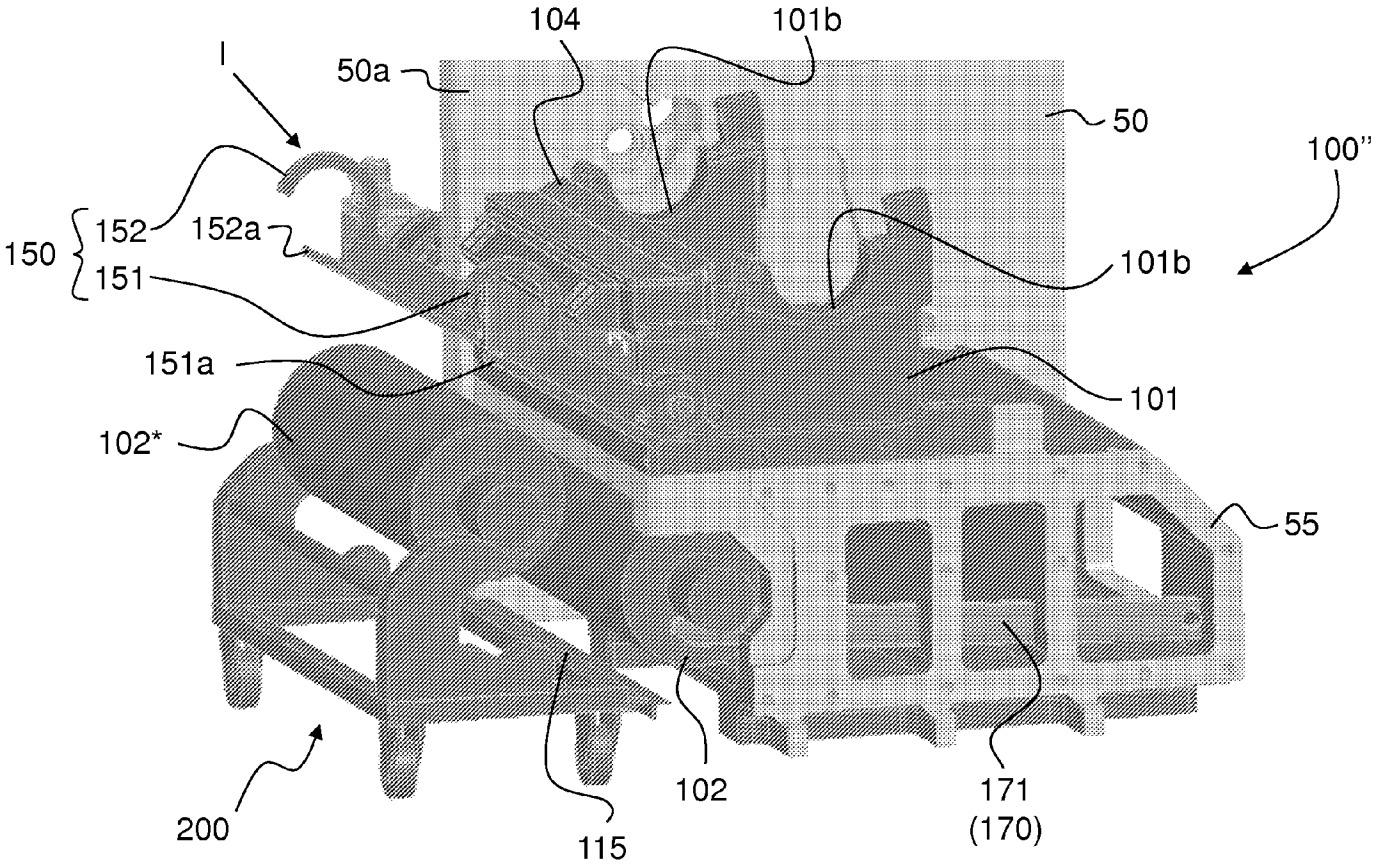
Figure 5F:
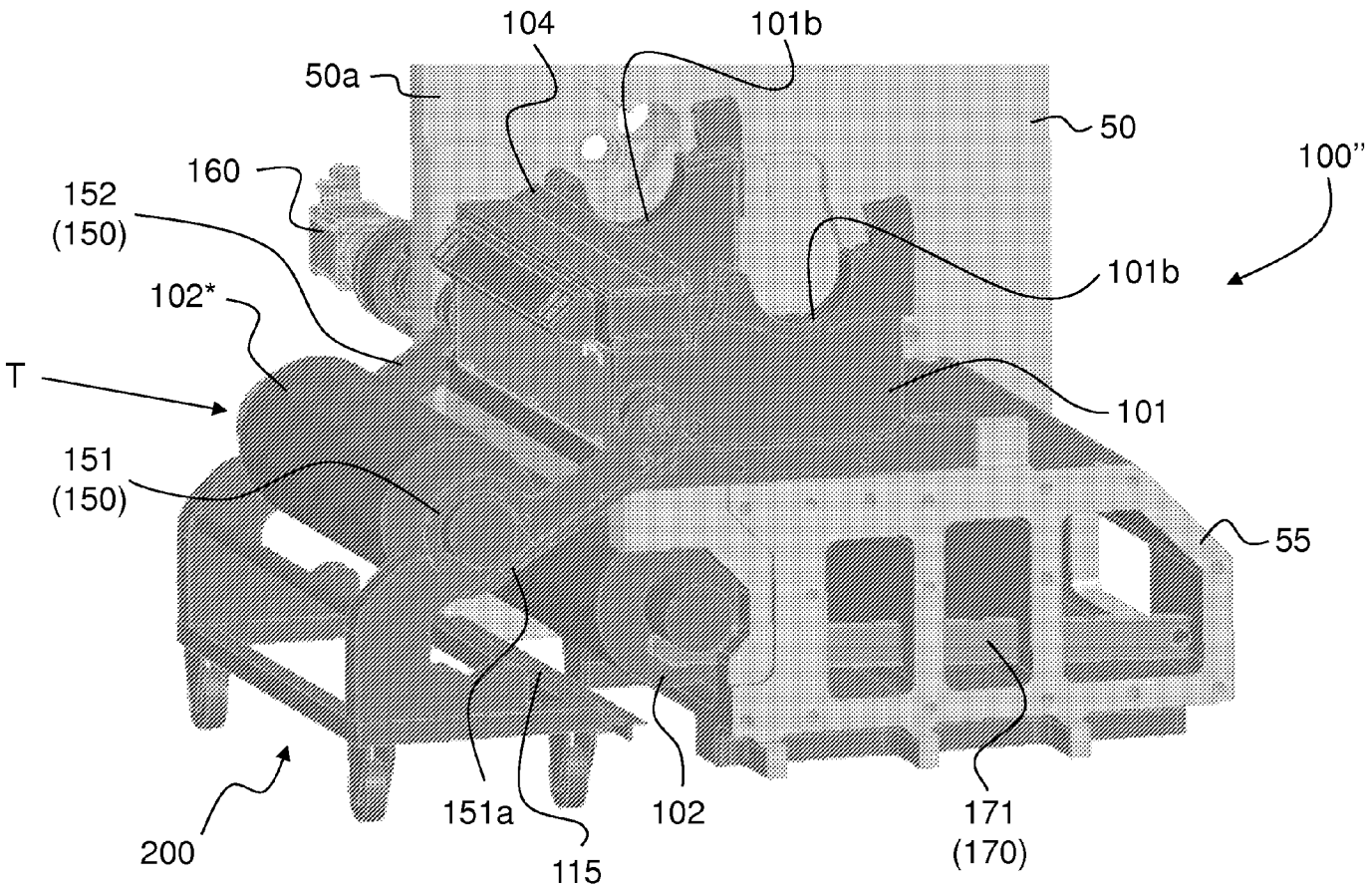

Once this has been done, a new wiping roller assembly 102* can be brought to the ink wiping system 100" by means of the trolley 200, which trolley 200 is guided and positioned with respect to the ink wiping system 100" by means of the interlocking mating guide 115, in a manner similar to the embodiment of FIGS. 4A-4L (see FIGS. 5D and 5E). In this example, the new wiping roller assembly 102* sits on the upper support portion 200*a* of the trolley 200.

Once the trolley 200 with the new wiping roller assembly 102* has been coupled to the ink wiping system 100", the wiping roller retracting device 150 can be actuated to bring the arms 151, 152 from the intermediate position I (FIG. 5E) to position T (FIG. 5F) where the arms 151, 152 can be coupled to both extremities of the new wiping roller assembly 102* which is sitting on the trolley 200.

Figure 5G:
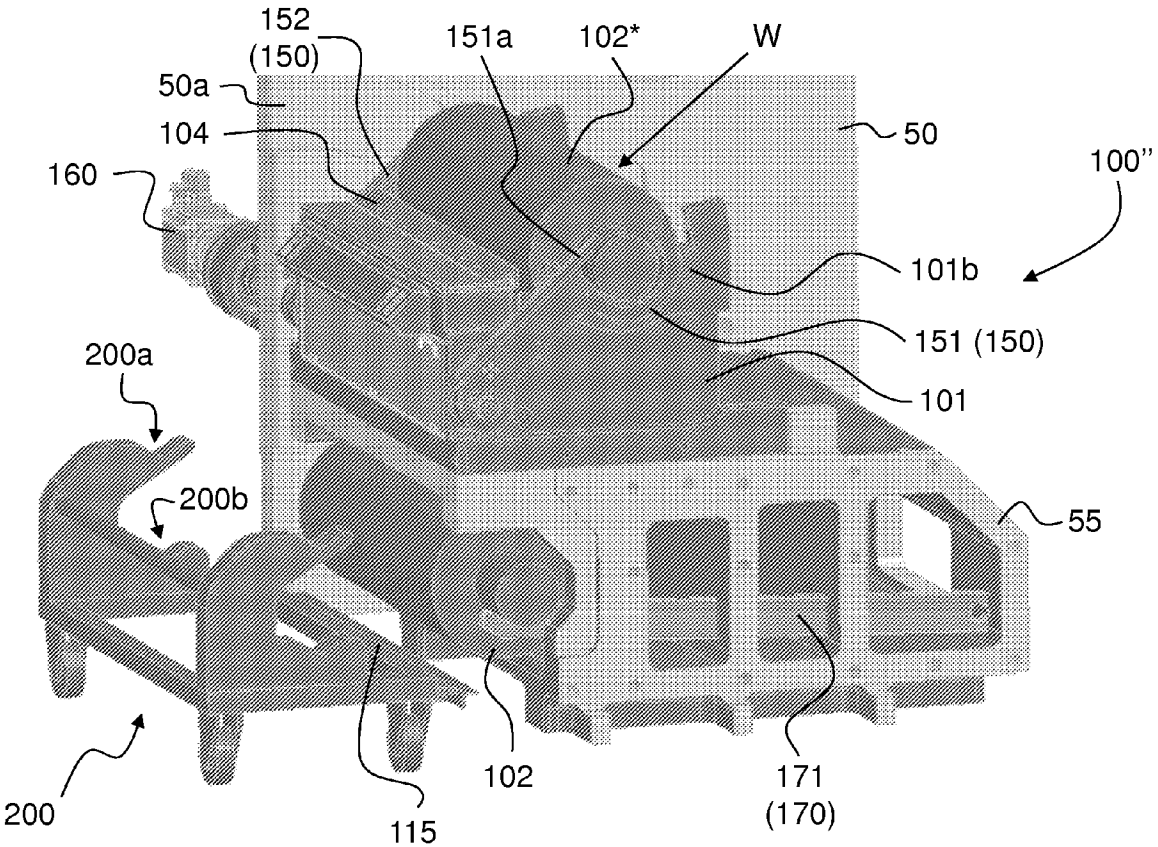

The wiping roller retracting device 150 can then be actuated to move the new wiping roller assembly 102* directly from the upper portion 200*a* of the trolley 200 to the working position W (see FIG. 5G).

Figure 5H:
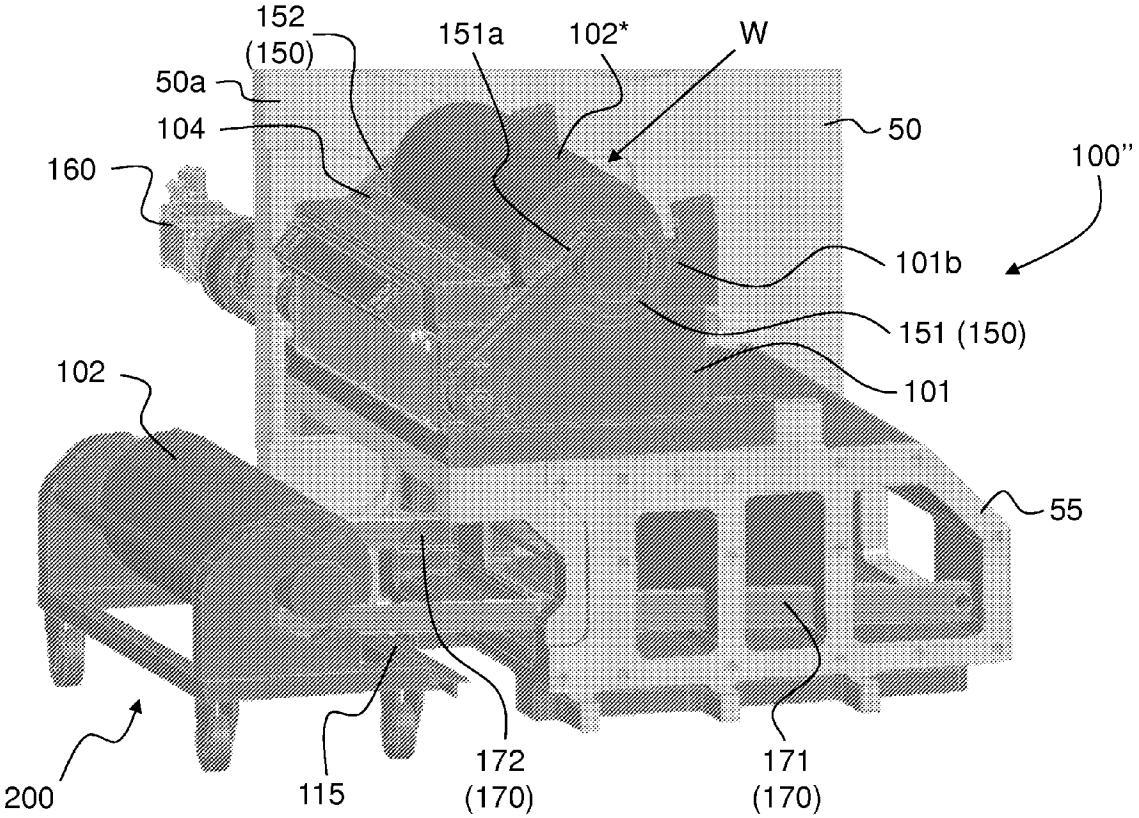
Figure 5I:
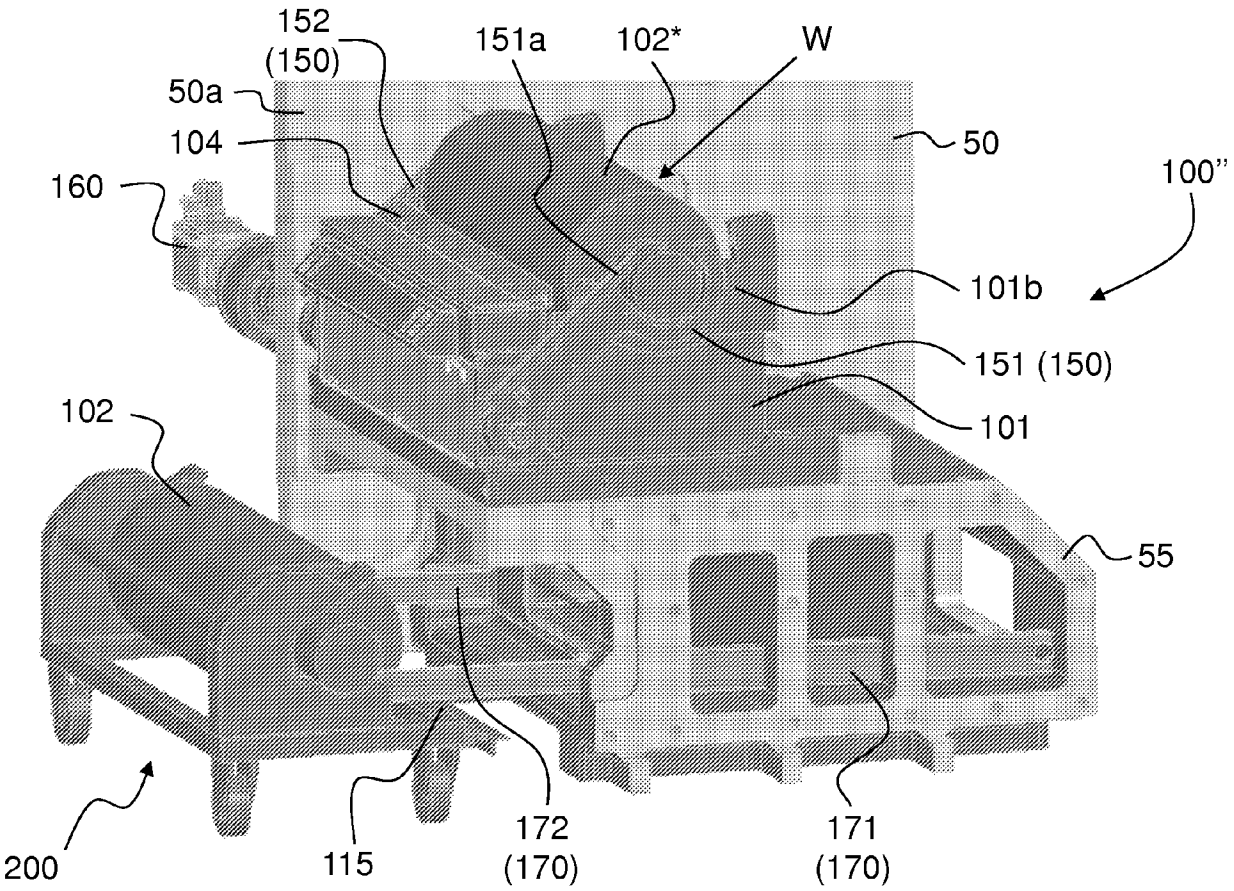
Figure 5J:
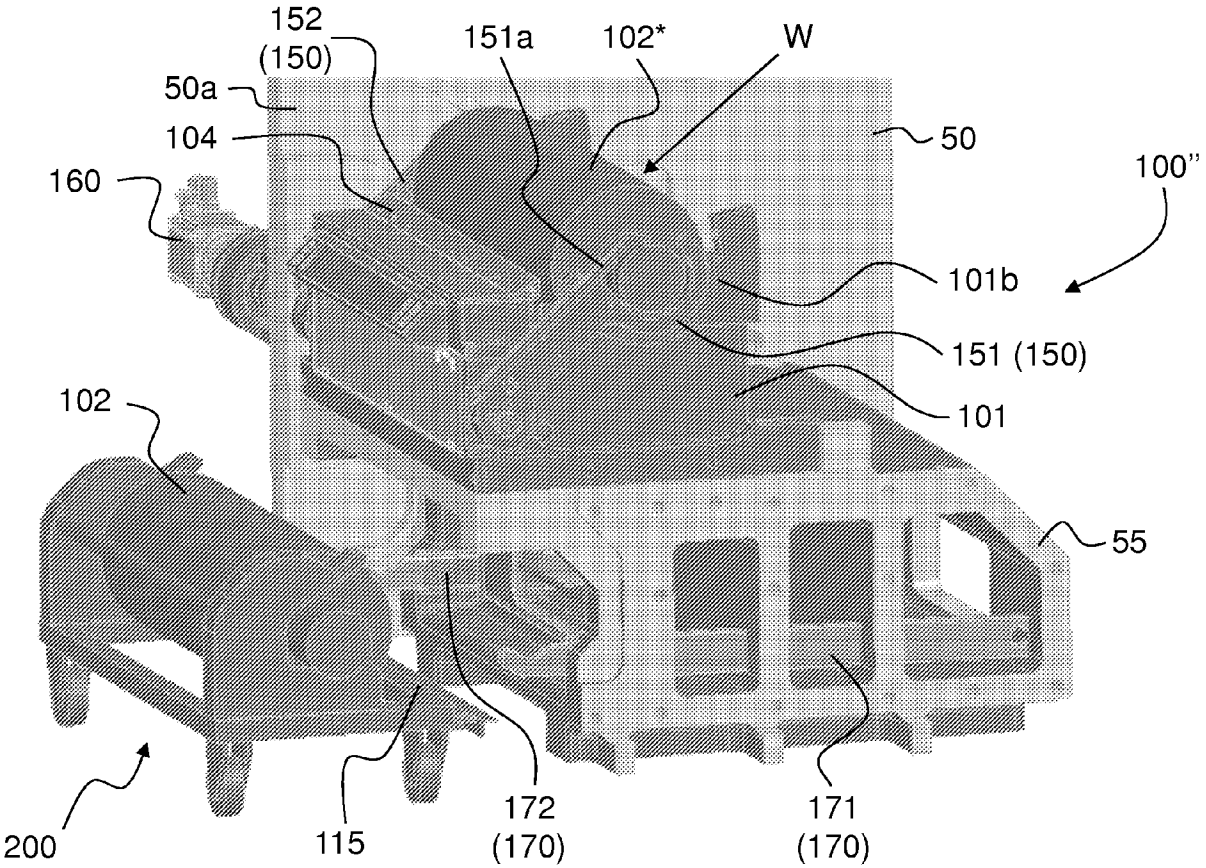

The trolley 200, freed of the new wiping roller assembly 102*, is now ready to receive the used wiping roller assembly 102 that is being temporarily stored in the storage section 110. In the illustrated example, this is achieved by means of the wiping roller holding device 170, the two arms 171, 172 thereof being advantageously designed as telescopic arms. As illustrated in FIGS. 5H and 5I, the telescopic arms 171, 172 are conveniently designed to allow the used wiping roller assembly 102 to be brought directly from the storage section 110 to the lower support portion 200*b* of the trolley 200, where the used wiping roller assembly 102 can be released. The wiping roller holding device 170 can then be brought back to its initial position, thereby allowing the trolley 200 to be evacuated with the used wiping roller assembly 102.

It will accordingly be understood that the embodiment of FIGS. 5A-5J only requires coupling of a single trolley 200 to the ink wiping system 100" for the purpose of exchanging the wiping roller assembly by another wiping roller assembly.

Various modifications and/or improvements may be made to the above-described embodiments without departing from the scope of the invention as defined by the annexed claims. For instance, while the disclosed embodiments make use of a pair of rotatable arms designed to pivot the wiping roller assembly about an axis of rotation, other arrangements could potentially be provided to move the wiping roller assembly between the working position and the parking position. A pivoting movement is however of substantial advantage in the context of the present invention, especially in view of the resulting compactness of the system.

In addition, as an alternative to the procedure illustrated in FIGS. 5A to 5J, one may contemplate to first position and interlock a trolley 200 carrying the new wiping roller assembly 102* on its lower support portion 200*b* and cause transfer of the new wiping roller assembly 102* to the empty storage section 110 by means of the arms 171, 172. Once this has been done, the wiping roller retracting device 150 can be actuated to cause movement of the used wiping roller assembly 102 from the working position W directly to the trolley 200 and release of the used wiping roller assembly 102 onto the upper support portion 200*a* of the trolley 200. Once the trolley 200 with the used wiping roller assembly 102 has been evacuated, the wiping roller retracting device 150 can again be actuated to catch the new wiping roller assembly 102* that is held in the storage section 110 and move it to the working position W.

LIST OF REFERENCE NUMERALS USED THEREIN

1 (sheet-fed) intaglio printing press
2 sheet feeder
3 intaglio printing unit
4 sheet delivery (with three delivery pile units)
5 optical inspection system (e.g. NotaSave®)
6 drying or curing unit
7 impression cylinder (three-segment cylinder)
8 plate cylinder (three-segment cylinder carrying three intaglio printing plates 8*a-c*)
8*a-c* intaglio printing plates
9 inking system (direct+indirect inking)
9.5 ink collecting cylinder/Orlof cylinder (two-segment cylinder)
9.10 ink duct (first inking unit)
9.11 pair of ink application rollers (first inking unit)
9.13 chablon cylinder/selective inking cylinder (first inking unit)
9.20 ink duct (second inking unit)
9.21 pair of ink application rollers (second inking unit)
9.23 chablon cylinder/selective inking cylinder (second inking unit)
9.30 ink duct (third inking unit)
9.31 pair of ink application rollers (third inking unit)
9.33 chablon cylinder/selective inking cylinder (third inking unit)
9.40 ink duct (fourth inking unit)
9.41 pair of ink application rollers (fourth inking unit)
9.43 chablon cylinder/selective inking cylinder (fourth inking unit)
9.44 additional ink roller (fourth inking unit)
10 ink wiping system
10' ink wiping system in retracted (maintenance) position
10.1 wiping tank
10.2 wiping roller assembly
10.3 cleaning means for removing wiped ink residues from the surface of the wiping roller assembly 10.2
10.4 drying blade for removing wiping solution residues from the surface of the wiping roller assembly 10.2
11 sheet transporting system (sheet conveyor system with a pair of endless chains driving a plurality of spaced-apart gripper bars for holding a leading edge of the sheets)
12 crane (for removing wiping roller assembly 10.2)
50 side frames (part of machine frame)
51 upright
50*a* channel or groove in side frames 50 (in the vicinity of the working position W)
50*b* channel or groove in side frames 50 (in the vicinity of the storage section 110)
55 wiping tank support (part of machine frame) supporting wiping tank 101
70 impression cylinder
80 plate cylinder
100 ink wiping system (embodiment of FIG. 3)
100' ink wiping system (embodiment of FIGS. 4A-4L)
100" ink wiping system (embodiment of FIGS. 5A-5J)
101 wiping tank
101*a* wiping roller bearing (upper part—removable)
101*b* wiping roller bearing (lower part—static)
102 (used) wiping roller assembly
102' wiping roller assembly 102 in parking position P (FIG. 3)
102* (new) wiping roller assembly
104 drying blade
110 storage section at parking position P
115 interlocking mating guide for guiding and positioning trolley 180 or 200 to machine frame
150 wiping roller retracting device
151 rotatable supporting arm (right-hand side)
151*a* movable retaining section of arm 151
152 rotatable supporting arm (left-hand side)
152*a* movable retaining section of arm 152
160 drive of wiping roller retracting device 150
170 wiping roller holding device
171 telescopic supporting arm (parking location P—right-hand side)
172 telescopic supporting arm (parking location P—left-hand side)

180 trolley (first embodiment FIGS. 4A-4L)
180*a* support portion of trolley 180
200 trolley (second embodiment FIGS. 5A-5J)
200*a* upper support portion of trolley 200
200*b* lower support portion of trolley 200
W defined working position/location of wiping roller assembly (FIGS. 3, 4A, 4B, 4L, 5A, 5G-5J)
P defined parking position/location of wiping roller assembly (FIGS. 3, 5B-5G)
O pivoting axis of wiping roller retracting device 150
I defined (first) intermediate position of wiping roller retracting device 150 (FIGS. 4E-4I, 5C-5E)
T defined (second) intermediate position of wiping roller retracting device 150 for interaction with trolley 180 or 200 (FIGS. 4D, 4J, 5F)
A pivoting movement of wiping roller assembly 102 from working position W to parking position P and vice versa (FIG. 3)

The invention claimed is:

1. An ink wiping system of an intaglio printing press comprising a wiping tank and a rotatable wiping roller assembly supported on and partly located in the wiping tank for wiping excess ink from the surface of a rotatable intaglio printing cylinder of the intaglio printing press, wherein the ink wiping system comprises a wiping roller retracting device which forms an integral part of the ink wiping system and is adapted to be coupled to the wiping roller assembly to move the wiping roller assembly between a working position where the wiping roller assembly is supported on and partly located in the wiping tank for cooperation with the intaglio printing cylinder and a parking position where the wiping roller assembly is retracted out of the wiping tank and away from the intaglio printing cylinder, wherein, in the working position of the wiping roller assembly, the wiping roller retracting device is coupled to the wiping roller assembly, and wherein the ink wiping system includes, at the parking position, a storage section adapted to receive the wiping roller assembly which is retracted by the wiping roller retracting device.

2. The ink wiping system as defined in claim 1, wherein the storage section is located immediately below the wiping tank.

3. The ink wiping system as defined in claim 1, wherein the wiping roller retracting device is adapted to release the wiping roller assembly in the parking position.

4. The ink wiping system as defined claim 3, wherein the storage section is provided with a wiping roller holding device adapted to hold the wiping roller assembly in the parking position upon release by the wiping roller retracting device.

5. The ink wiping system as defined in claim 4, wherein the wiping roller holding device comprises first and second arms adapted to be brought into cooperation with a respective one of first and second extremities of the wiping roller assembly.

6. The ink wiping system as defined in claim 1, further comprising an interlocking mating guide designed to guide and position a trolley with respect to the ink wiping system and along a path of the wiping roller retracting device, which trolley is designed to allow exchange of a used wiping roller assembly by a new wiping roller assembly.

7. The ink wiping system as defined in claim 6, wherein the wiping roller retracting device is adapted to move and release the used wiping roller assembly in the parking position, prior to coupling of a trolley to the interlocking mating guide, and wherein the storage section is provided with means for transferring the used wiping roller assembly from the storage section onto the trolley coupled to the interlocking mating guide.

8. An ink wiping system of an intaglio printing press comprising a wiping tank and a rotatable wiping roller assembly supported on and partly located in the wiping tank for wiping excess ink from the surface of a rotatable intaglio printing cylinder of the intaglio printing press, wherein the ink wiping system comprises a wiping roller retracting device which forms an integral part of the ink wiping system and is adapted to be coupled to the wiping roller assembly to move the wiping roller assembly between a working position where the wiping roller assembly is supported on and partly located in the wiping tank for cooperation with the intaglio printing cylinder and at least one retracted position where the wiping roller assembly is retracted out of the wiping tank and away from the intaglio printing cylinder, wherein, in the working position of the wiping roller assembly, the wiping roller retracting device is coupled to the wiping roller assembly, and wherein the ink wiping system further comprises an interlocking mating guide designed to guide and position a trolley with respect to the ink wiping system and along a path of the wiping roller retracting device, which trolley is designed to allow exchange of a used wiping roller assembly by a new wiping roller assembly.

9. The ink wiping system as defined in claim 6, wherein the wiping roller retracting device is adapted to move and release the used wiping roller assembly directly onto a trolley coupled to the interlocking mating guide.

10. The ink wiping system as defined in claim 6, wherein the wiping roller retracting device is adapted to take up the new wiping roller assembly sitting on a trolley coupled to the interlocking mating guide and move the new wiping roller assembly directly from the trolley to the working position.

11. The ink wiping system as defined in claim 1, wherein the wiping roller retracting device is adapted to pivot the wiping roller assembly away from and to the working position.

12. The ink wiping system as defined in claim 11, wherein the wiping roller retracting device comprises first and second rotatable supporting arms adapted to be coupled at one end to a respective one of first and second extremities of the wiping roller assembly.

13. The ink wiping system as defined in claim 11, wherein the wiping roller retracting device is pivotally supported onto the wiping tank.

14. The ink wiping system as defined in claim 1, wherein the wiping tank is fixedly secured to a machine frame of the intaglio printing press and cannot move with respect to the machine frame.

15. An intaglio printing press comprising an ink wiping system as defined in claim 1.

16. The ink wiping system as defined in claim 8, wherein the wiping roller retracting device is adapted to move and release the used wiping roller assembly directly onto a trolley coupled to the interlocking mating guide.

17. The ink wiping system as defined in claim 8, wherein the wiping roller retracting device is adapted to take up the new wiping roller assembly sitting on a trolley coupled to the interlocking mating guide and move the new wiping roller assembly directly from the trolley to the working position.

18. The ink wiping system as defined in claim 8, wherein the wiping roller retracting device is adapted to pivot the wiping roller assembly away from and to the working position.

19. The ink wiping system as defined in claim 18, wherein the wiping roller retracting device comprises first and second rotatable supporting arms adapted to be coupled at one end to a respective one of first and second extremities of the wiping roller assembly.

20. The ink wiping system as defined in claim 18, wherein the wiping roller retracting device is pivotally supported onto the wiping tank.

21. The ink wiping system as defined in claim 8, wherein the wiping tank is fixedly secured to a machine frame of the intaglio printing press and cannot move with respect to the machine frame.

22. An intaglio printing press comprising an ink wiping system as defined in claim 8.

* * * * *